US010274171B2

(12) United States Patent
Goelz et al.

(10) Patent No.: US 10,274,171 B2
(45) Date of Patent: Apr. 30, 2019

(54) ADJUSTABLE LED LIGHT FIXTURE FOR USE IN A TROFFER

(71) Applicant: Cree, Inc., Durham, NC (US)

(72) Inventors: Dave Goelz, Milwaukee, WI (US); John Adams, Cary, NC (US)

(73) Assignee: Cree, Inc., Durham, NC (US)

( * ) Notice: Subject to any disclaimer, the term of this patent is extended or adjusted under 35 U.S.C. 154(b) by 26 days.

(21) Appl. No.: 15/400,212

(22) Filed: Jan. 6, 2017

(65) Prior Publication Data

US 2018/0195673 A1 Jul. 12, 2018

(51) Int. Cl.

| | |
|---|---|
| ***F21S 8/02*** | (2006.01) |
| ***F21V 3/02*** | (2006.01) |
| ***F21V 7/00*** | (2006.01) |
| ***F21V 13/04*** | (2006.01) |
| ***F21V 14/04*** | (2006.01) |
| ***F21V 17/02*** | (2006.01) |
| ***F21V 23/00*** | (2015.01) |
| ***F21V 29/70*** | (2015.01) |
| ***F21V 15/015*** | (2006.01) |
| ***F21Y 103/10*** | (2016.01) |

(Continued)

(52) U.S. Cl.

CPC ..... *F21V 15/015* (2013.01); *F21S 8/026* (2013.01); *F21V 14/04* (2013.01); *F21V 3/02* (2013.01); *F21V 7/005* (2013.01); *F21V 13/04* (2013.01); *F21V 17/02* (2013.01); *F21V 23/004* (2013.01); *F21V 29/70* (2015.01); *F21Y 2103/10* (2016.08); *F21Y 2113/13* (2016.08); *F21Y 2115/10* (2016.08)

(58) Field of Classification Search

None

See application file for complete search history.

(56) References Cited

U.S. PATENT DOCUMENTS

| | | | |
|---|---|---|---|
| 8,736,186 | B2 | 5/2014 | Chobot |
| 8,829,821 | B2 | 9/2014 | Chobot et al. |
| 8,912,735 | B2 | 12/2014 | Chobot et al. |

(Continued)

OTHER PUBLICATIONS

U.S. Appl. No. 61/932,058, filed Jan. 27, 2014.
U.S. Appl. No. 62/292,528, filed Feb. 8, 2016.

*Primary Examiner* — Britt D Hanley
(74) *Attorney, Agent, or Firm* — Myers Bigel, P.A.

(57) ABSTRACT

The light fixture is configured to be mounted in a troffer. The light fixture includes a light emitting assembly including at least one LED and a reflector assembly. A mechanical attachment mechanism is configured to be connected directly between the light fixture and a troffer. The mechanical attachment mechanism is adjustable such that a distance between the light fixture and the troffer may vary. The mechanical attachment mechanism may comprise at least one bracket pivotably connected to the light fixture, a cable having an attachment structure wherein the effective length of the cable is adjustable, a telescoping bracket having an attachment structure wherein the effective length of the telescoping bracket is adjustable, a threaded member having an attachment structure wherein the effective length of the threaded member is adjustable by a threaded nut that engages the threaded member. The mechanical attachment mechanism positively secures the light fixture to the troffer without gaps to create an electrical enclose that prevents risk of fire or shock.

20 Claims, 30 Drawing Sheets

(51) Int. Cl.
*F21Y 113/13* (2016.01)
*F21Y 115/10* (2016.01)

(56) References Cited

U.S. PATENT DOCUMENTS

| | | | | |
|---|---|---|---|---|
| 8,975,827 | B2 | 3/2015 | Chobot et al. | |
| 9,155,165 | B2 | 10/2015 | Chobot | |
| 9,155,166 | B2 | 10/2015 | Chobot | |
| 9,433,061 | B2 | 8/2016 | Chobot | |
| 2014/0001959 | A1 | 1/2014 | Motley et al. | |
| 2014/0268790 | A1 | 9/2014 | Chobot et al. | |
| 2015/0102729 | A1 | 4/2015 | Creasman et al. | |
| 2016/0091158 | A1* | 3/2016 | Scribante ..... | F21S 8/026<br>362/223 |

* cited by examiner

ADJUSTABLE LED LIGHT FIXTURE FOR USE IN A TROFFER

BACKGROUND OF THE INVENTION

The invention relates to lighting fixtures and, more particularly, to indirect, direct, and direct/indirect lighting troffers that are well-suited for use with solid state lighting sources, such as light emitting diodes (LEDs).

Troffer-style fixtures are ubiquitous in residential, commercial, office and industrial spaces throughout the world. In many instances these troffer-style fixtures include troffers that house elongated fluorescent light bulbs that span the length of the troffer. Troffers may be mounted to or suspended from ceilings. Often the troffer may be recessed into the ceiling, with the back side of the troffer protruding into the plenum area above the ceiling. Elements of the troffer on the back side may dissipate heat generated by the light source into the plenum where air can be circulated to facilitate the cooling mechanism.

More recently, with the advent of efficient solid state lighting sources, these troffers have been used with LEDs, for example. LEDs are solid state devices that convert electric energy to light and generally comprise one or more active regions of semiconductor material interposed between oppositely doped semiconductor layers. When a bias is applied across the doped layers, holes and electrons are injected into the active region where they recombine to generate light. Light is produced in the active region and emitted from surfaces of the LED.

LEDs have certain characteristics that make them desirable for many lighting applications that were previously the realm of incandescent or fluorescent lights. LEDs can emit the same luminous flux as incandescent and fluorescent lights using a fraction of the energy. In addition, LEDs can have a significantly longer operational lifetime.

In some cases, it may be desirable to replace or retrofit existing troffer-style fixtures, which have, for example, fluorescent light bulbs with newer LED light sources.

SUMMARY OF THE INVENTION

In some embodiments a light fixture is configured to be mounted in a troffer. The light fixture comprises a light emitting assembly comprising at least one LED and a reflector assembly. A mechanical attachment mechanism is configured to be connected directly between the light fixture and a troffer. The mechanical attachment mechanism is adjustable such that a distance between the light fixture and the troffer may vary.

The reflector assembly may comprise a back reflector where the back reflector may comprise at least two reflectors where one of the two reflectors may be movable relative to the light emitting assembly. The reflector assembly may comprise two side reflectors where one of the two side reflectors is moveable relative to the light emitting assembly. The mechanical attachment mechanism may comprise an attachment structure configured to be secured to the troffer such that the distance between the attachment structure and the light fixture is adjustable. The mechanical attachment mechanism may comprise at least one bracket pivotably connected to the light fixture. The bracket may comprise an attachment structure where the distance between the attachment structure and the light fixture is adjustable by pivoting of the bracket. The bracket may be secured against pivoting movement. The mechanical attachment mechanism may comprise two brackets pivotably connected to the light fixture. The brackets may cross one another. The brackets may be secured to one another. The mechanical attachment mechanism may comprise a cable having an attachment structure wherein the effective length of the cable is adjustable to change the distance between the attachment structure and the light fixture. The mechanical attachment mechanism may comprise a telescoping bracket having an attachment structure wherein the effective length of the telescoping bracket is adjustable to change the distance between the attachment structure and the light fixture. The mechanical attachment mechanism may comprise a threaded member having an attachment structure wherein the effective length of the threaded member is adjustable by a threaded nut that engages the threaded member to change the distance between the attachment structure and the light fixture.

In some embodiments a light fixture is configured to be mounted in a troffer. The light fixture comprises a light emitting assembly comprising at least one LED and a reflector assembly. A mechanical attachment mechanism is secured to the light fixture and a troffer. The mechanical attachment mechanism comprises an attachment structure spaced from the light fixture where the position of the attachment structure is adjustable relative to the light fixture such that the distance between the attachment structure and the light fixture is changeable.

The mechanical attachment mechanism may comprise at least one bracket pivotably connected to the light fixture where the distance between the attachment structure and the light fixture is changed by pivoting of the bracket. The the mechanical attachment mechanism may comprise two brackets pivotably connected to the light fixture. The brackets may cross one another. The two brackets may be secured to one another. The mechanical attachment mechanism mechanically secures the light fixture directly to the troffer to create an enclosure independently of any surrounding support system. The mechanical attachment mechanism may comprise a cable wherein the effective length of the cable is adjustable to change the distance between the attachment structure and the light fixture. The mechanical attachment mechanism may comprise a telescoping bracket comprising a plurality if sections movable relative to one another wherein the effective length of the telescoping bracket is adjustable to change the distance between the attachment structure and the light fixture. The mechanical attachment mechanism may comprise a threaded member wherein the effective length of the threaded member is adjustable by a threaded nut that engages the threaded member to change the distance between the attachment structure and the light fixture.

DETAILED DESCRIPTION OF EMBODIMENTS OF THE INVENTION

Figure 1:
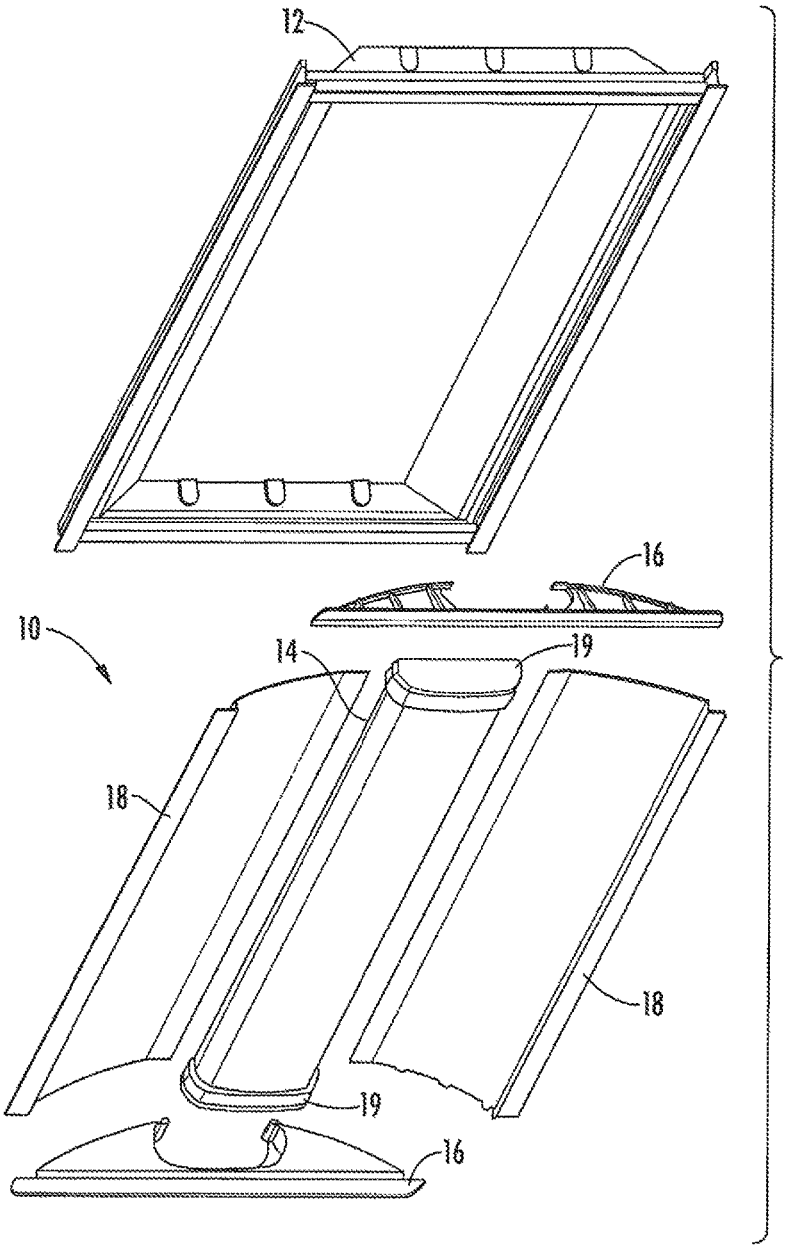
FIG. 1 is an exploded perspective view of a lighting fixture according to an embodiment of the present disclosure and a troffer.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element such as a layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" or "top" or "bottom" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

Unless otherwise expressly stated, comparative, quantitative terms such as "less" and "greater", are intended to encompass the concept of equality. As an example, "less" can mean not only "less" in the strictest mathematical sense, but also, "less than or equal to."

The terms "LED" and "LED device" as used herein may refer to any solid-state light emitter. The terms "solid state light emitter" or "solid state emitter" may include a light emitting diode, laser diode, organic light emitting diode, and/or other semiconductor device which includes one or more semiconductor layers, which may include silicon, silicon carbide, gallium nitride and/or other semiconductor materials, a substrate which may include sapphire, silicon, silicon carbide and/or other microelectronic substrates, and one or more contact layers which may include metal and/or other conductive materials. A solid-state lighting device produces light (ultraviolet, visible, or infrared) by exciting electrons across the band gap between a conduction band and a valence band of a semiconductor active (light-emitting) layer, with the electron transition generating light at a wavelength that depends on the band gap. Thus, the color (wavelength) of the light emitted by a solid-state emitter depends on the materials of the active layers thereof. In various embodiments, solid-state light emitters may have peak wavelengths in the visible range and/or be used in combination with lumiphoric materials having peak wavelengths in the visible range. Multiple solid state light emitters and/or multiple lumiphoric materials (i.e., in combination with at least one solid state light emitter) may be used in a single device, such as to produce light perceived as white or near white in character. In certain embodiments, the aggregated output of multiple solid-state light emitters and/or lumiphoric materials may generate warm white light output having a color temperature range of from about 2200K to about 6000K.

Solid state light emitters may be used individually or in combination with one or more lumiphoric materials (e.g., phosphors, scintillators, lumiphoric inks) and/or optical elements to generate light at a peak wavelength, or of at least one desired perceived color (including combinations of colors that may be perceived as white). Inclusion of lumiphoric (also called 'luminescent') materials in lighting devices as described herein may be accomplished by direct coating on solid state light emitter, adding such materials to encapsulants, adding such materials to lenses, by embedding or dispersing such materials within lumiphor support elements, and/or coating such materials on lumiphor support elements. Other materials, such as light scattering elements (e.g., particles) and/or index matching materials, may be associated with a lumiphor, a lumiphor binding medium, or a lumiphor support element that may be spatially segregated from a solid state emitter.

Embodiments of the present invention provide a direct troffer-style light fixture that is particularly well-suited for use with solid state light sources, such as LEDs and retrofit structures for use in pan-style troffers. The light fixture may be removably attached within a T grid or troffer structure. The troffer structure may be an already existing component or may be provided with the retrofit light fixture. The retrofit light fixture includes a lens structure, which creates an interior space. The interior space created by the lens structure houses light emitters and in some circumstances a light engine and/or additional electronics. First and second end reflectors surround the lens and are disposed at either end of the lens. One or both of these end reflectors may be movable. Optionally, one or more end caps may be incorporated into the end portions of the lens structure to section off the interior space of the lens for housing electronics, such as a light engine. A light board may be removably attached to the base of the lens structure. A back reflector covers most of the interior surfaces of the troffer fixture to direct more light out of the fixture. A connection mechanism is provided for mechanically fixing the light fixture directly to the troffer.

FIG. 1 is an exploded perspective view of a lighting fixture 10 according to an embodiment of the present invention. The fixture 10 can fit or be placed within a troffer 12. The troffer 12 may be an already existing component or it may be provided with the light fixture 10. In a retrofit application the troffer may be previously installed in a ceiling or other structure. However, the troffer may form part of the light fixture in a new installation. The light fixture 10 includes lens 14, which houses light emitters. On either end of the lens 14 are end reflectors 16, which fit around the lens 14 and help keep the lens in place. Situated between the end reflectors 16 and surrounding the lens 14 are back reflectors 18. Back reflectors 18 may be a singular back reflector, which spans the entire back side of the fixture or may be two separate panels as shown in FIG. 1. The reflectors 18 may be stationary or movable/removable, for ease of installation. FIG. 1 also shows optional end caps 19.

The light fixture described in the present disclosure provides easy installation in a retrofit troffer. The size and shape of the light fixture are also adjustable during installation to fit an existing troffer 12. The light fixture 10 can be adjusted in length by means of sliding at least one of the end reflectors 16 along the length of the lens 14. The width of the light fixture 10 can be adjusted by sliding at least one of the reflectors 18 toward or away from the other reflector 18. This allows the installer the means to make adjustments to the size and shape of the retrofit light fixture to accommodate the existing troffer 12 and to fit the fixture 10 into an existing troffer 12 during installation. The sliding and/or rotating reflectors also make it easier when installing and wiring the light fixture. Previously, fixtures would be installed as many different components; however, embodiments according to the present disclosure allow for installation in fewer pieces. In some embodiments, the fixtures may only be adjusted in size during installation, and returned to a fixed length and width once installation is completed. In other embodiments, the adjustments may be made to the final installed fixture as well.

In some embodiments, the back reflector may be multiple pieces and one of them may be installed separately. In order to install a retrofit fixture 10 into an existing troffer the legacy fluorescent tubes 302, tombstone connectors 305, lens 310, ballast 306 and ballast cover 304 may be removed from the troffer 300 (see FIG. 13). The fixtures according to the present disclosure are self-contained retrofit troffers that may be installed with relatively fewer parts. The fixture has interlocking end reflectors 16, such that one end reflector 16 is interlocked with the lens 14 and slides and/or rotates along the lens during installation, while the other end reflector 16 may be fixed in place. The back reflectors 18 are also designed to slide away, be removed, or nest during installation and wiring and then be deployed by sliding them down along the end caps and lens, or placing a removed back reflector back in place.

Figure 2:
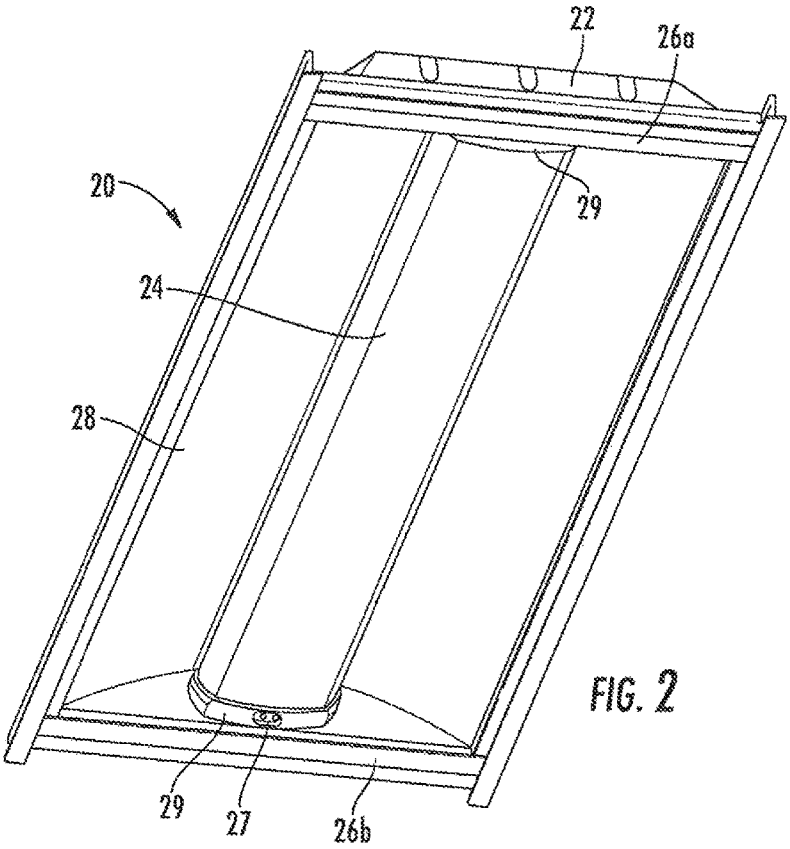
FIG. 2 is a perspective view of a lighting fixture according to an embodiment of the present disclosure mounted in a troffer.

FIG. 2 is a perspective view of a light fixture 20 mounted in troffer 22 according to an embodiment of the present disclosure. Fixture 20 is similar to the one shown in FIG. 1, in the assembled or installed configuration. Some embodiments, such as the one shown here include a lens 24 which houses an LED board and LEDs, a sliding end reflector **26*a* and a fixed end reflector 26*b*, a pair of back reflectors 28, and a driver housed behind or in the lens 24 on the same side as the fixed end reflector 26*b*. FIG. 2 shows an optional troffer 22, the interior of which is not very visible because the interior is covered by the fixture 20. The length and width of the light fixture 20 may be adjusted by moving end reflector 26*b* and back reflectors 28, such that they may be slid further from or closer to the center or lens 24 of the fixture. The reflectors may be removably attached to the remainder of the fixture by several methods, such as snap fit, screws, fasteners, alignment holes, or any other method. The fixture 20 may also optionally include end caps 29 and sensing equipment or openings for the same 27**.

With reference to FIG. 2, in the embodiment of light fixture 20, the back reflector 28 comprises two pieces, that join in the middle to form a single reflective body. In other embodiments, the back reflector can be one monolithic structure. The reflectors are shaped to substantially cover the area of the interior space of troffer 22 to redirect any light toward the open end of the fixture. In some embodiments, the reflectors are faceted or have faceted surfaces. In other embodiments, the reflectors are faceted to create the bended shape; however a back reflector with a smooth bending transition may be used. Many different back reflector shapes are possible.

Figure 3A:
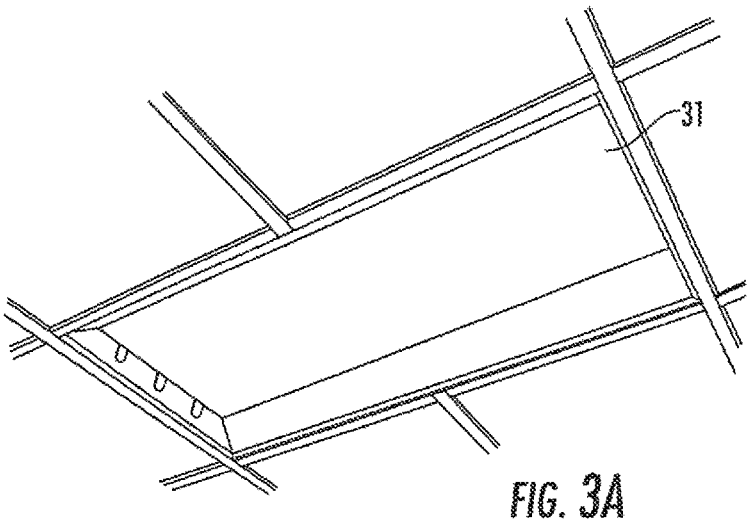
FIGS. 3A-3D are perspective views of a fixture according to the present disclosure in several stages of installation.
Figure 3B:
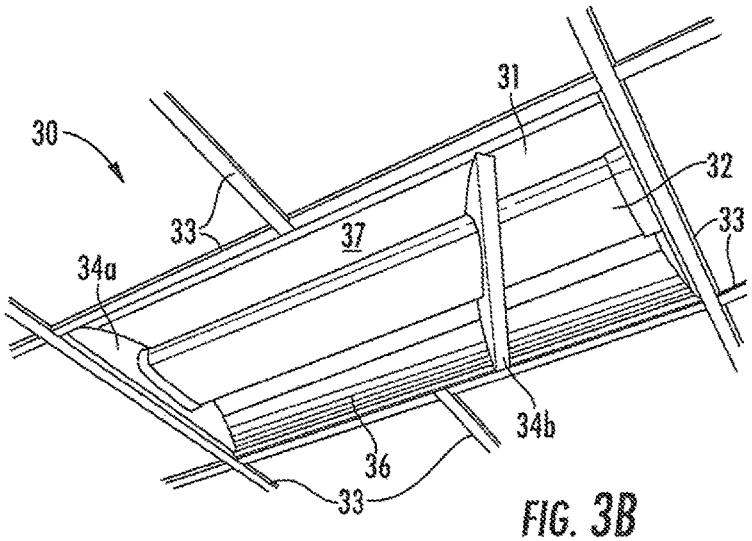
Figure 13:
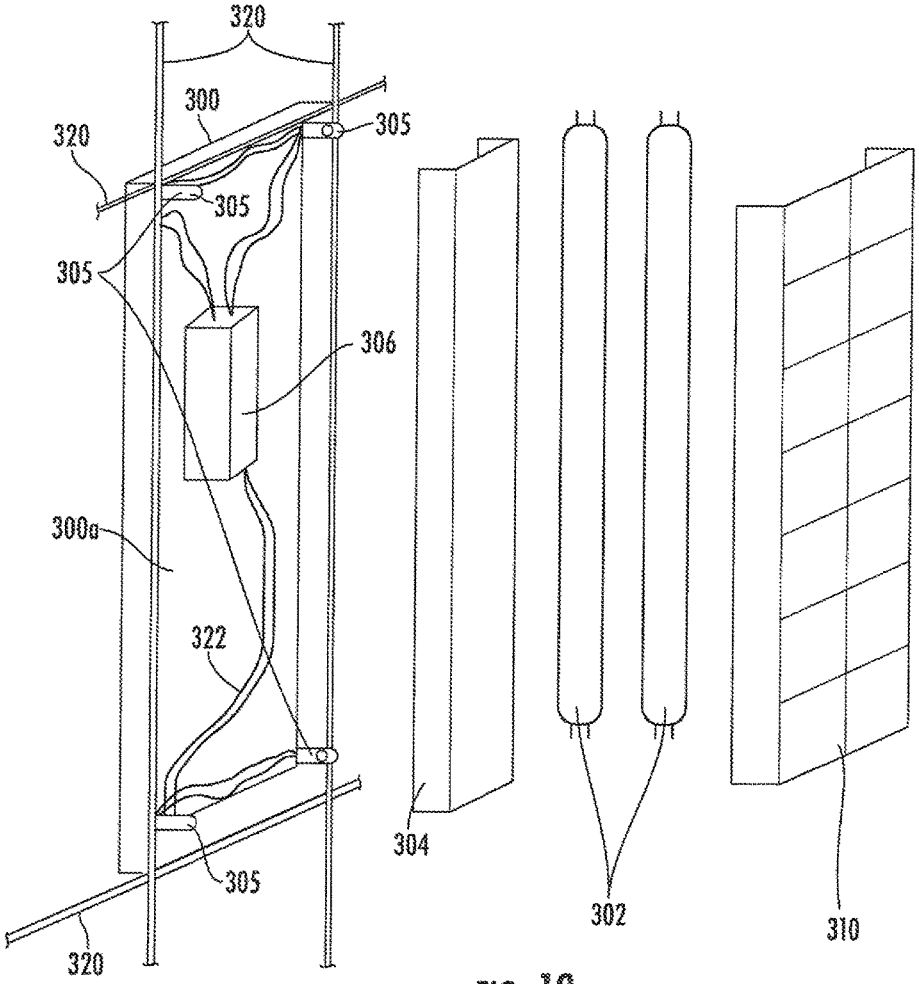
FIG. 13 is an exploded perspective view showing a dismantled fluorescent light fixture.

FIGS. 3A-3D show an exemplary process of installing a light fixture in a troffer according to an embodiment of the present disclosure. FIG. 3A shows an empty ceiling troffer 31, which may have been installed in this manner or been emptied after the removal of a previous fixture such as fluorescent tubes 302, tombstone connectors 305, lens 310, ballast cover 304 and ballast 306 as shown in FIG. 13. FIG. 3B shows the light fixture 30 during the first step of installation. In FIG. 3B, the first piece of the light fixture 30 is placed within the troffer 31 or T grid 33. This first piece includes a back reflector 36, a stationary end reflector 34, lens and light emitters 32, a fixed end reflector 34*a* and a movable end reflector 34*b*. As seen in FIG. 3B, the side of the lens 32 opposite the back reflector 36 does not have a second back reflector in place and a portion of the troffer 31 is exposed via opening 37. This is done intentionally in order to allow for the fixture to be placed within the troffer 31, because the troffer 31 or T grid have a lip which is narrower than the area the fixture resides, the fixture must be narrower than the lip during the initial installation. Therefore, it is necessary that one of the end reflectors be movable from the edge, and rotatable, in order to reduce the length during installation. It is also necessary that one of the back reflectors be slidable or removable in order to reduce overall width of the fixture during insertion into the troffer. Removing one of the back reflectors during installation facilitates making the electrical connection to the light fixture.

Figure 3C:
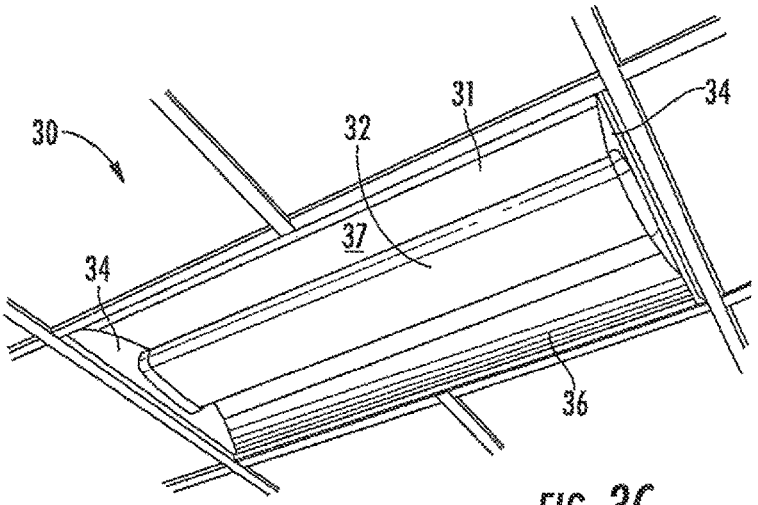
Figure 3D:
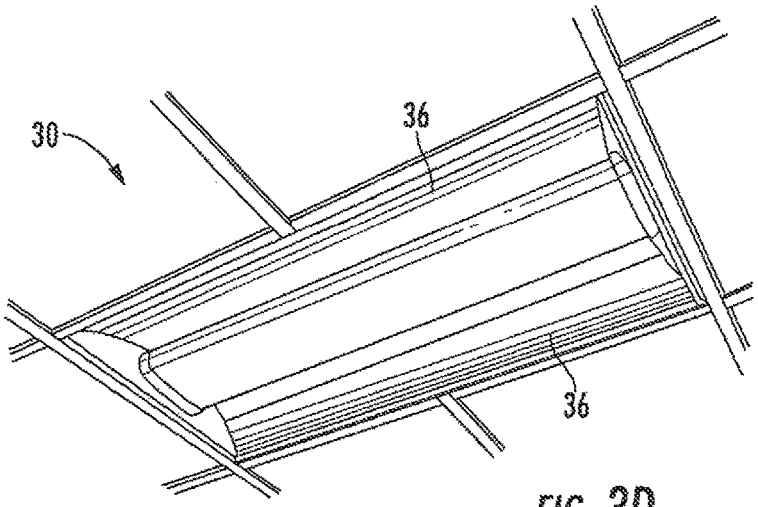

FIG. 3C shows the fixture 30 in the next step of the installation. In this step, the movable end reflector 34*b* is rotated and slid relative to lens 32 to the final position at the edge of the troffer 31. During this step, once the end reflector 34*b* is in place, an installer may then use the opening 37 on the opposite side of the back reflector 36 to complete fixture wiring. FIG. 3D shows fixture 30 fully installed with both of the back reflectors 36 fully in place, such that the troffer 31 is no longer visible. The reflectors may be disposed at many angles to accommodate different output profiles. The end reflectors and back reflectors should comprise a reflective surface on the side that faces the interior space or lens. When assembled, the end reflectors perform several functions: they retain elements within the compartments (in embodiments with end compartments); they provide added structural stability to the fixture; they aid in aligning the lens; and they reflect light that impinges on them toward the open end of the fixture. These end compartments may house a variety of items, such as driver circuits, circuit isolation structures, batteries, sensors, or other appropriate electronics.

Figure 4:
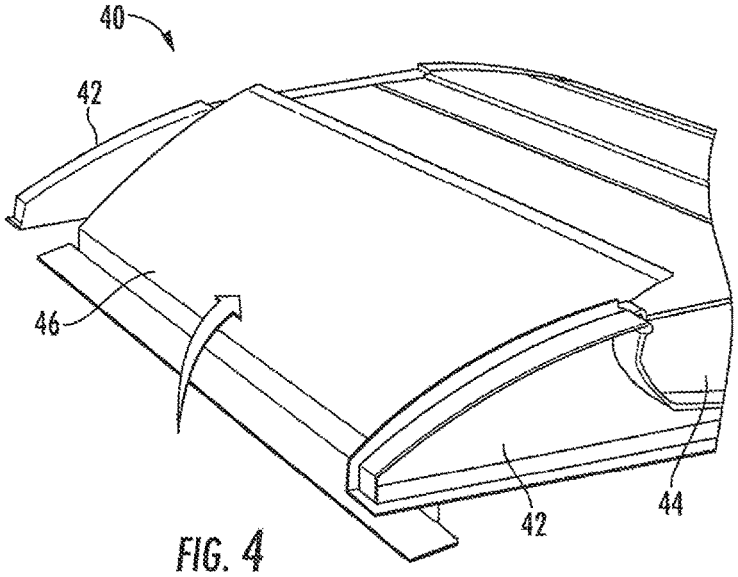
FIG. 4 is a back perspective view of the fixture according to an embodiment of the present disclosure.

FIG. 4 is a perspective view of the back side of an exemplary fixture 40, showing one embodiment of a movable or removable back reflector 46. As shown, the back reflector 46, between end reflectors 42, is partially in place and partially slid over the lens 44. This view shows how a reflector may be slid into place after installation of the remainder of the fixture 40, such as between the installation steps shown in FIGS. 3C and 3D.

Figure 5:
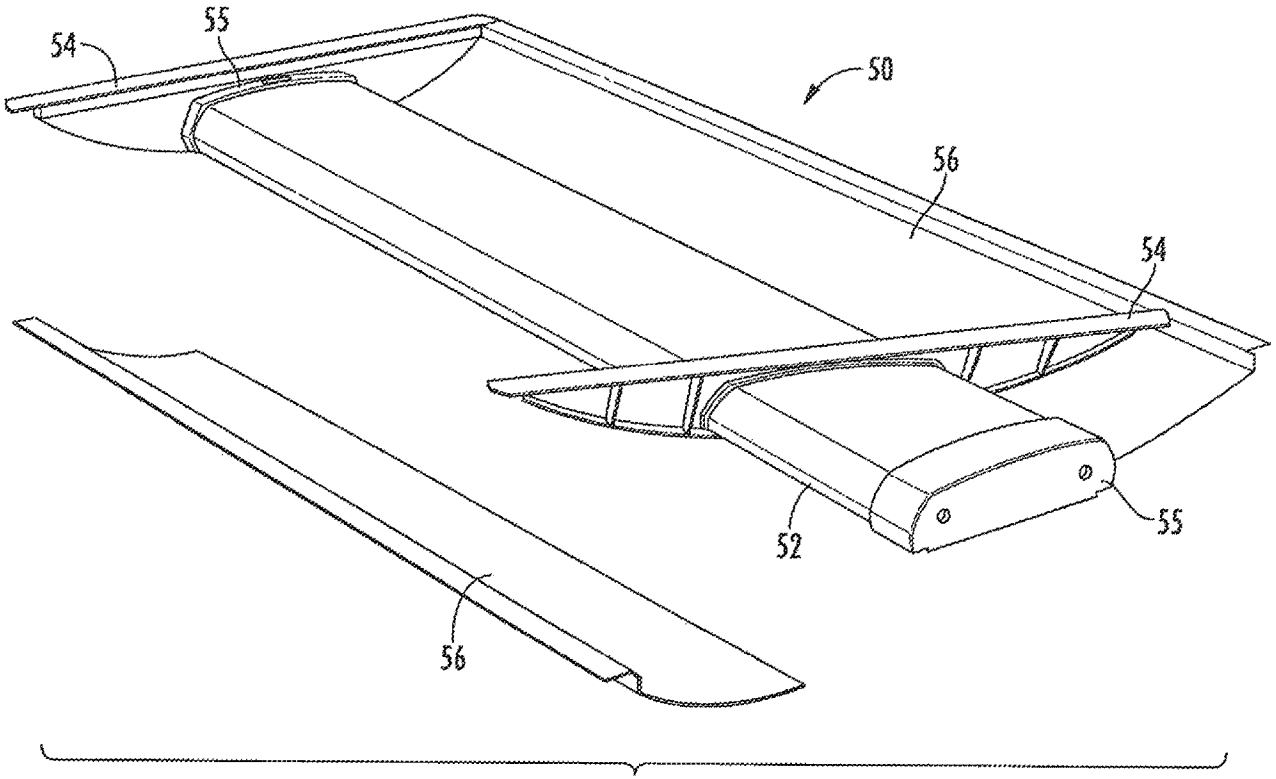
FIG. 5 is a perspective view of a fixture before installation according to one embodiment of the present disclosure.
Figure 6:
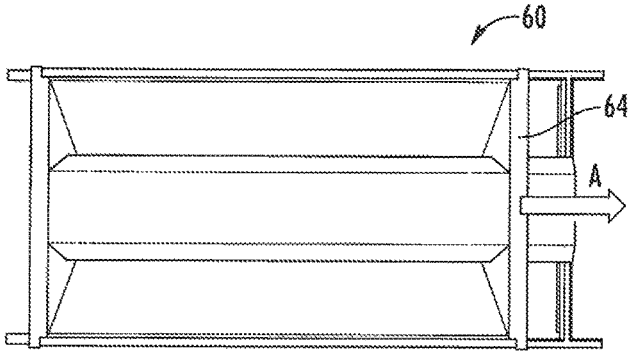
FIGS. 6, 7A, and 7B show detailed views of the first end reflector in different positions during installation that may be used in embodiments of the present disclosure.

FIG. 5 is another perspective view of a fixture 50 in a configuration for installation into a T grid or troffer. As shown, the fixture 50 includes a center lens 52, end reflectors 54, back reflectors 56, and optional end caps 55. Though one center lens 52 is shown, it is understood this may also be a collection of lenses. Also, though a tubular lens is shown, it is understood that this lens may also be a cover. Additionally, though the lens 52 is shown to be centered, the lens may also be situated on either or both sides of the fixture and multiple lenses and associated LED assemblies may be provided. The configuration as shown, with one end reflector 54 slid away from the end and rotated and one back reflector temporarily removed, allows for the fixture to be placed in a T grid or troffer and fit through the narrowed portion of the same. Although only one end reflector is shown to be moved, while the other is stationary, in other embodiments, both end reflectors 54 may be slidable and rotatable. The end reflectors 54 may be made of a variety of materials, such as plastics or metals. The end reflectors may also be reflective, such that they are made of or include a coating of a metal or a white highly reflective material. The lens 52 may be include optional end caps 55 or in other embodiments there may not be additional outer end caps (as shown in FIG. 6). In place of an end cap 55, a division or end cap area may be present inside the lens 52, to provide mechanical shielding. The area within the end cap or end cap area can be used to house electronics. The electronics may be housed only on the side of the stationary end reflector 54 or on both sides. These areas may also house environmental sensing technologies, which can be used to change operation of the light.

FIG. 5 shows one of the back reflectors 56 removed from the remainder of the fixture. In place of removal, in other embodiments, the back reflector may be slid up and behind the center lens or fixture, in order to accommodate the narrowed portion of the T grid or pan during installation and allow for access behind the fixture to complete wiring during installation. The back reflectors may be made of or coated with a reflective metal, plastic, or white material. One suitable metal material to be used for the reflectors being aluminum (Al). The end and back reflectors may also include diffusing components if desired. The back reflector may be mounted to the remainder of the fixture using tabs, notches, screws, snap or slide in mechanisms, or other fastening methods. Having one of the back reflectors be removable or movable is advantageous as maintenance can be done from the room-side or the ceiling-side without having to remove the fixture from its mount or significantly disassemble any portion of the fixture.

The back and end reflectors may comprise many different materials. For many indoor lighting applications, it is desirable to present a uniform, soft light source without unpleasant glare, color striping, or hot spots. Thus, the back reflectors may comprise a diffuse white reflector, such as a microcellular polyethylene terephthalate (MCPET) material or a DuPont/WhiteOptics material, for example. Other white diffuse reflective materials can also be used. The back reflectors may also be aluminum with a diffuse white coating.

It is understood that many different fixture and reflector assemblies may be used to achieve a particular output light profile. The fixtures shown can be provided in many sizes, including standard troffer fixture sizes, such as 2 feet by 4 feet (2'×4') or 2 feet by 2 feet (2'×2'), for example. However, it is understood that the elements of the shown fixtures may have different dimensions that correspond to the fixture sizes. Furthermore, it is understood that embodiments of the fixture can be customized to fit most any desired fixture dimension.

Figure 7A:
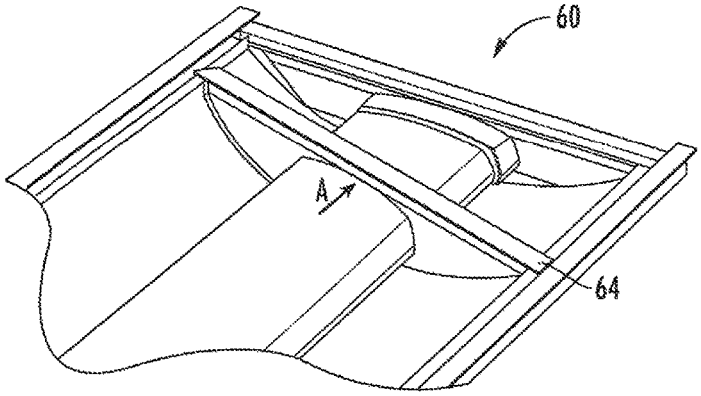
Figure 7B:
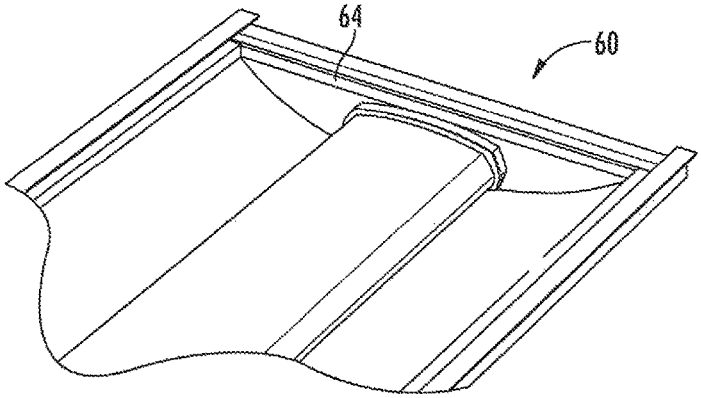

FIGS. 6, 7A, and 7B show how the end reflector 64 of fixture 60 may be moved from the position shown in FIG. 5 to an installed position in FIG. 7B. The end reflector 60 may be moved in the direction shown by the arrow, towards the end of the fixture 60. If the end reflector 60 has been rotated, it may also need to be straightened, as shown in FIGS. 6 and 7A. FIG. 7B shows the end reflector 60 in the final installed position. It should be understood, if it is desired that the end reflector be placed further toward the center, to accommodate a particular application, the end reflector may be placed in other positions than shown in the figures.

Figure 8:
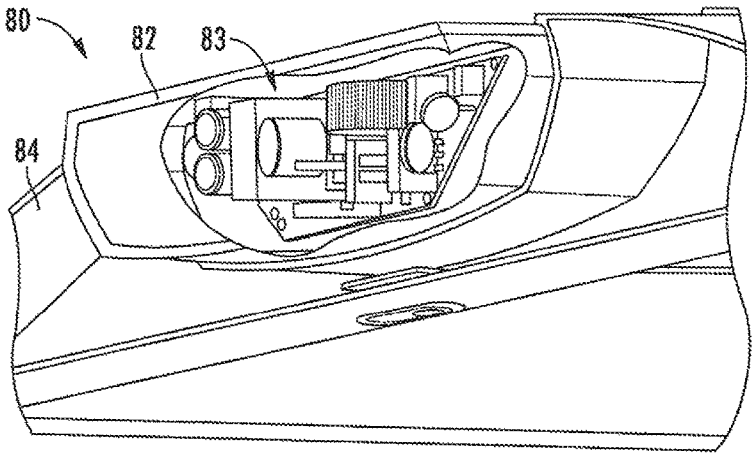
FIG. 8 is a side view of an end compartment according to one embodiment of the present disclosure.
Figure 9:
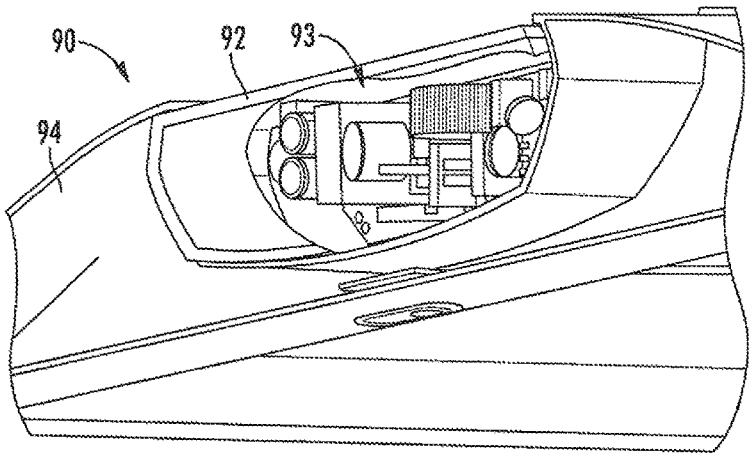
FIG. 9 is another side view of an end compartment with the end reflector in a different position according to one embodiment of the present disclosure.

FIGS. 8 and 9 show side views of the fixture 80, 90, depicting the component compartment 83, 93, at the end of the lens 82, 92. This compartment 83, 93, may be created by an inner divider or end cap, or an outer end cap as shown in FIG. 5. The end compartment 83, 93, is also defined by the end reflector 84, 94, which surrounds the compartment when in the installed position. As shown in FIG. 8, the end reflector 84 is slid away from the end of lens 92, and in FIG. 9 the end reflector 94 is slid to the end of the lens 92. These compartments provide space to house various components, such as circuits, batteries, wiring, and the like. In this particular embodiment, a driver circuit is housed with a compartment. Electronic components within the compartments may be shielded and isolated from the remainder of the lens. Here, an isolation structure may partially surround the driver circuit for this purpose. The isolation structure may also function as a flame barrier (e.g., Formex™, ceramic, or a UL94 5VA rated transparent plastic) which is required to cover the high voltage components if they are used.

Various driver circuits may be used to power the light sources. Suitable circuits are compact enough to fit within the compartments, while still providing the power delivery and control capabilities necessary to drive high-voltage LEDs, for example. At the most basic level a driver circuit may comprise an AC to DC converter, a DC to DC converter, or both. In one embodiment, the driver circuit comprises an AC to DC converter and a DC to DC converter, both of which are located inside the compartment. In another embodiment, the AC to DC conversion is done remotely (i.e., outside the fixture), and the DC to DC conversion is done at the control circuit inside the compartment. In yet another embodiment, only AC to DC conversion is done at the control circuit within the compartment.

Figure 10:
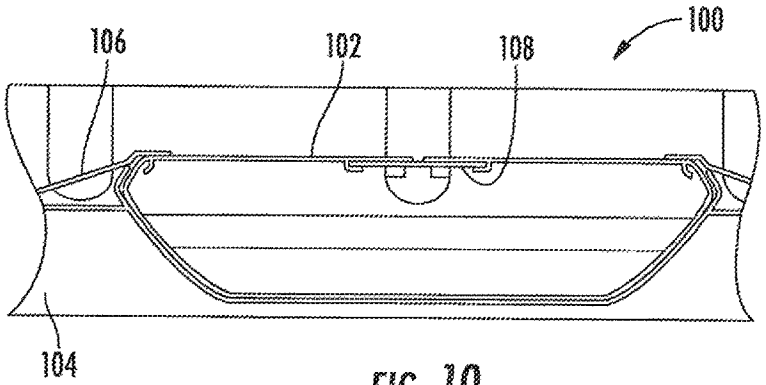
FIG. 10 is a representative cross-sectional side view of a fixture according to one embodiment of the present disclosure.

FIG. 10 shows a cross section of the fixture 100, showing the interlocking end reflector 104, back reflector 106, and lens 102. The lens 102 houses a light board with light emitters 108. The light board may be any appropriate board, such as a PCB or flexible circuit board. Light emitters may include any appropriate light emitters, such as LEDs. The light board and light emitters, or lighting strips can include the electronics and interconnections necessary to power the light emitters or LEDs. In some embodiments the lighting strip comprises a PCB with the LEDs mounted and interconnected thereon. The lighting strip may include clusters of discrete LEDs, with each LED within the cluster spaced a distance from the next LED, and each cluster spaced a distance from the next cluster. If the LEDs within a cluster are spaced at too great a distance from one another, the colors of the individual sources may become visible, causing unwanted color-striping. In some embodiments, an acceptable range of distances for separating consecutive LEDs within a cluster is not more than approximately 8 mm. Some embodiments may use a series of clusters having two blue-shifted-yellow LEDs ("BSY") and a single red LED ("R"). Once properly mixed the resultant output light will have a "warm white" appearance. Other embodiments may use a series of clusters having three BSY LEDs and a single red LED. This scheme will also yield a warm white output when sufficiently mixed. Yet other embodiments may use a series of clusters having two BSY LEDs and two red LEDs. This scheme will also yield a warm white output when sufficiently mixed.

The light board may be permanently attached or, more likely, may be removably attached to the lens by being slid into a holding mechanism or mounted via alignment holes (not shown). The light board aligns with the center portion of the end reflectors and lens. Additionally, the back reflectors may also be slid into place or mounted via alignment holes. The reflectors and the light boards can be mounted with similar mechanisms, such as retention clips. It is understood that nearly any length of light board can be used. In some embodiments, any length can be built by combining light boards together to yield the desired length. The light sources or emitters can be mounted in a linear pattern or in clusters. In some embodiments, the light sources may be mounted to a light strip and then to the light board.

The lens 102 may be a singular piece or may be constructed of multiple assembled pieces. The lens 102 may be made of plastic, such as extruded plastic. In other embodiments, the front portion of the lens 102 may be made of plastic, such that is it clear or diffuse while allowing light to exit the fixture. In some embodiments, the back area of the lens 102 or the surfaces on the side of the lens adjacent to the light emitters and light board 108 may be reflective. For example, this area may be coated with a white reflective material. In other embodiments, this area of the lens may be sheet metal, such that the front section is extruded plastic, which is snapped in place to a metal back portion. The front area of the lens 102 may be uniform or may have different features and diffusion levels. In other embodiments, portions of the lens may be diffusive, whereas other portions may be reflective. In yet other embodiments, a portion of the lens may be more diffuse than the remainder of the lens.

Figure 11:
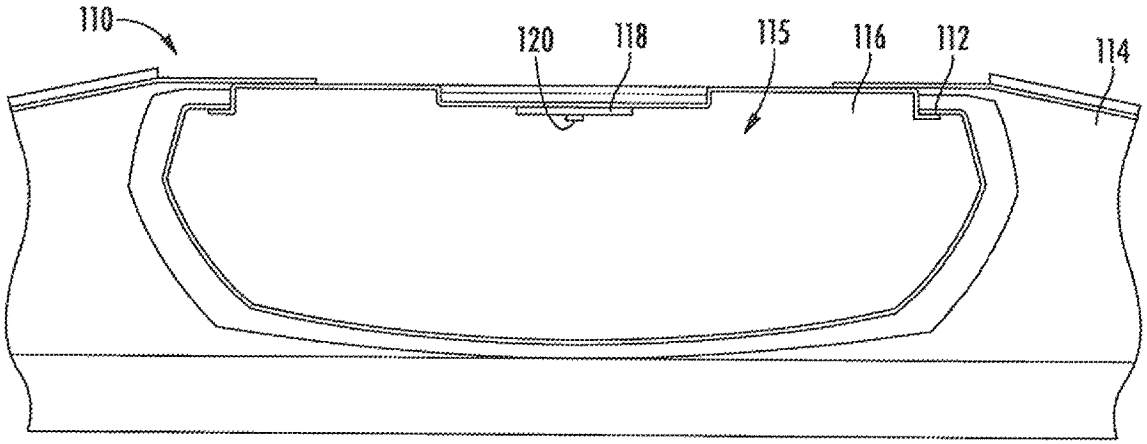
FIG. 11 is a partial side view of a fixture according to an embodiment of the present disclosure.
Figure 12:
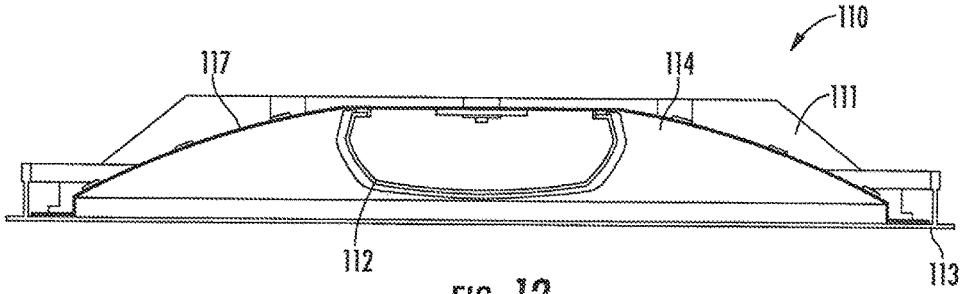
FIG. 12 is a full side view of the fixture of FIG. 11 mounted in a troffer.

FIGS. 11 and 12 are additional side views of a fixture 110 according to the present disclosure. FIG. 11 is a close up view of the fixture 110 shown in FIG. 12. FIG. 11 shows a lens 112, which defines an interior compartment 115. End reflector 114 surrounds the lens 112 and compartment 115. An end cap 116 may also define a portion of the interior compartment. The interior of the lens also includes light board 118 with associated light emitters 120. FIG. 12 shows the fixture 110 installed or mounted within a troffer 111 that is in a T grid 113. As shown, the fixture 110, which includes back reflector 117, lens 112, and end reflector 114, is placed between the T grid 113 and troffer 111.

The light fixture may be mounted within a T grid by being placed on the T grid or positioned between an existing pan and a T grid. In other embodiments, additional attachments, such as tethers, may be included to stabilize the fixture in case of earthquakes or other disturbances. A tether may be installed after the fixture is put in place and before the second portion of the back reflector is put in place.

The lighting schemes shown in the figures are meant to be exemplary. Thus, it is understood that many different dimensions of light emitter, lens, and reflector combinations can be used to generate a desired output and light color. In some embodiments it may be desirable or necessary to mechanically fix the light fixture to the troffer such that support of the light fixture does not rely solely on the T-grid.

In some embodiments, as will be described in more detail below, a light fixture is provided that includes a direct mechanical connection between the light fixture and the troffer. Such an arrangement is particularly useful when retrofitting a light fixture to an existing troffer because it allows the light fixture to be directly mechanically secured to the troffer while the light fixture is partially installed in the troffer.

Figure 16:
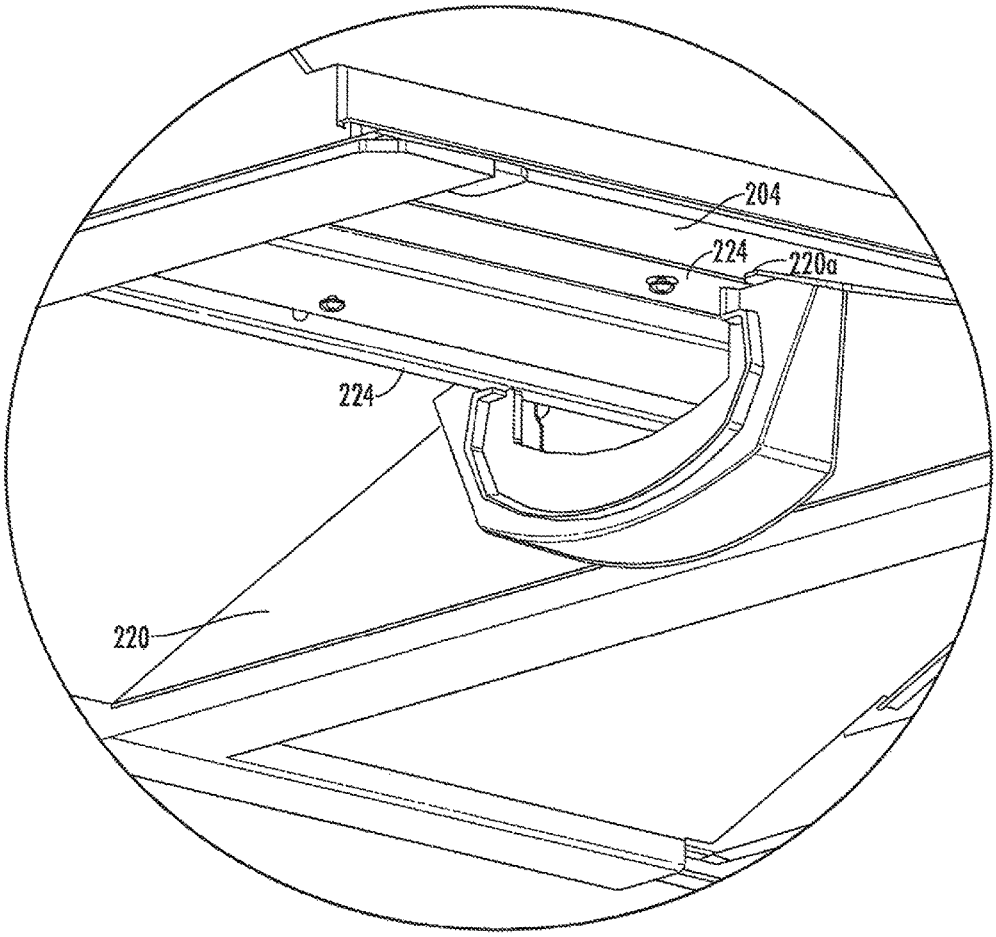
FIG. 16 is a detailed perspective view of FIG. 15.
Figure 17:
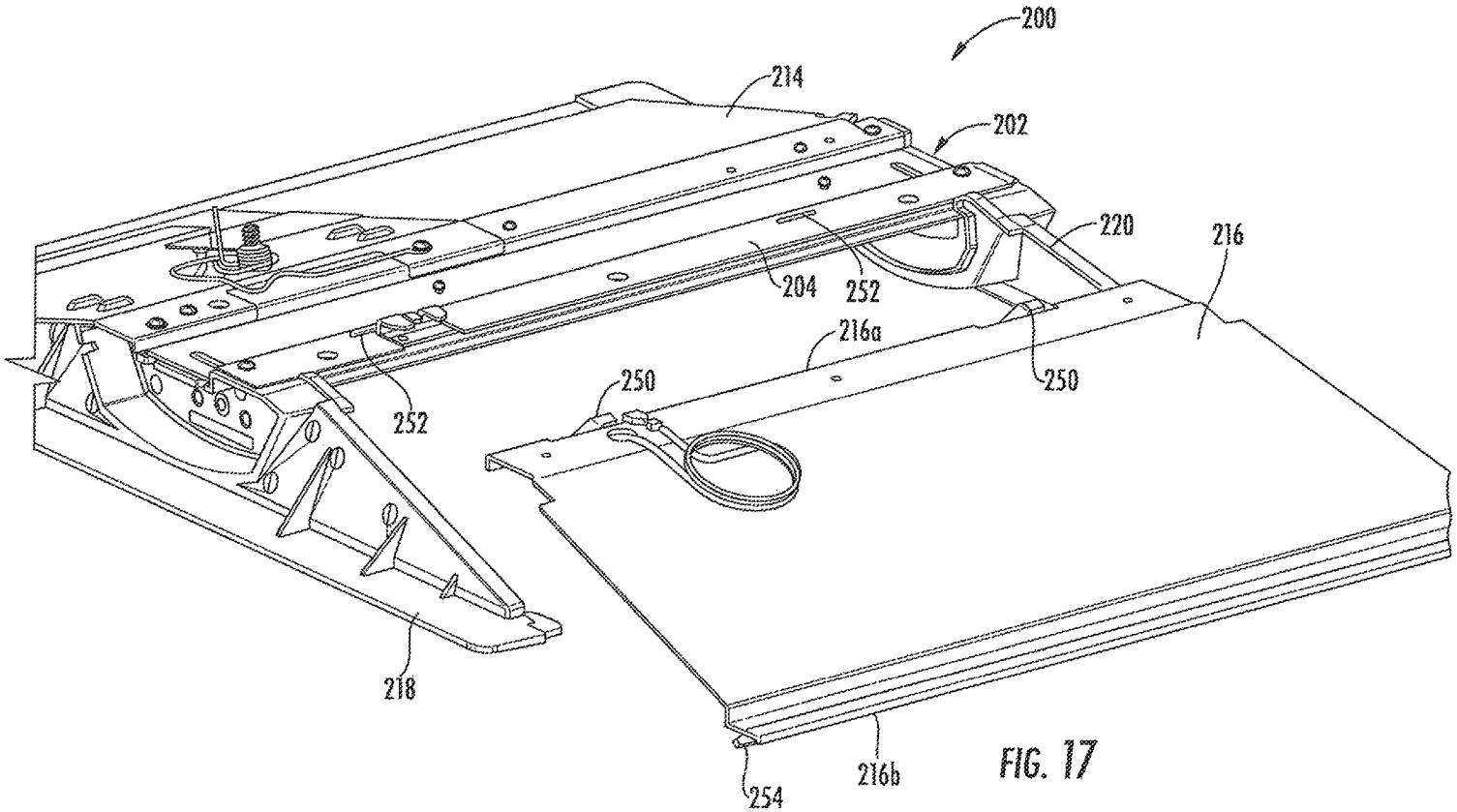
FIG. 17 is a reverse partially exploded perspective view showing the light fixture of FIG. 14.
Figure 18:
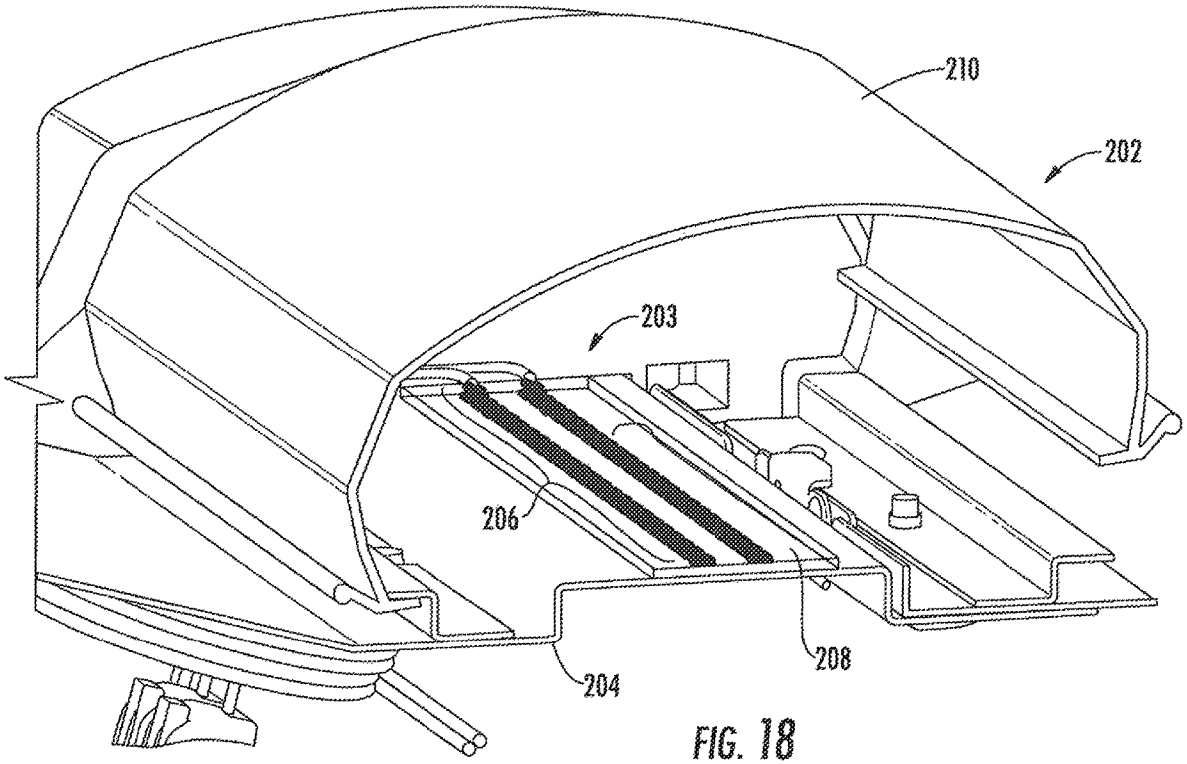
FIG. 18 is a detailed perspective view showing the light fixture of FIG. 14.
Figure 19:
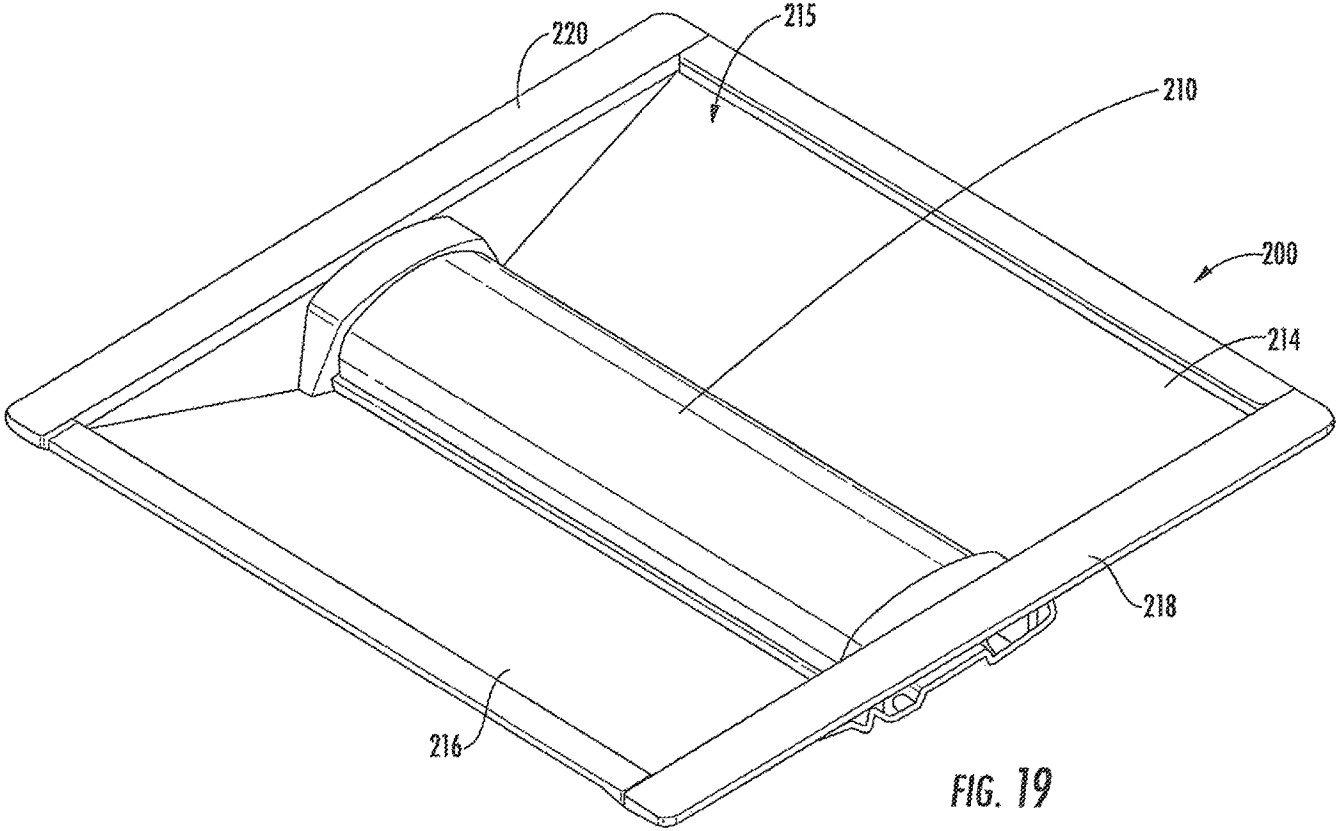
FIG. 19 is a perspective view showing the complete light fixture of FIG. 14.

Referring to FIGS. 14-19, the light fixture 200 comprises a light emitting assembly 202 comprising an elongated rigid support structure 204 supporting an LED assembly 203 comprising a plurality of LEDs 206 mounted on a LED board 208. The support structure 204 may comprise a thermally conductive material such that it functions as a heat sink to dissipate heat from the LED assembly 203. The LED board 208 provides physical support for the LEDs 206 and may provide the electrical connection to the LEDs 206 for delivering current to the LEDs. The LED board 208 may comprise a PCB, flex circuit or the like and may be connected to the support structure 204 by any suitable connection mechanism including adhesive, screws, snap-fit connectors, board receptacles or the like. A lens 210 covers the LEDs 206 and may be connected to the support structure 204 using a snap-fit connector as shown in FIG. 18. The lens 210 may be diffusive to assist in color mixing the light emitted by the LEDs although it may in some embodiments be transparent.

Figure 20:
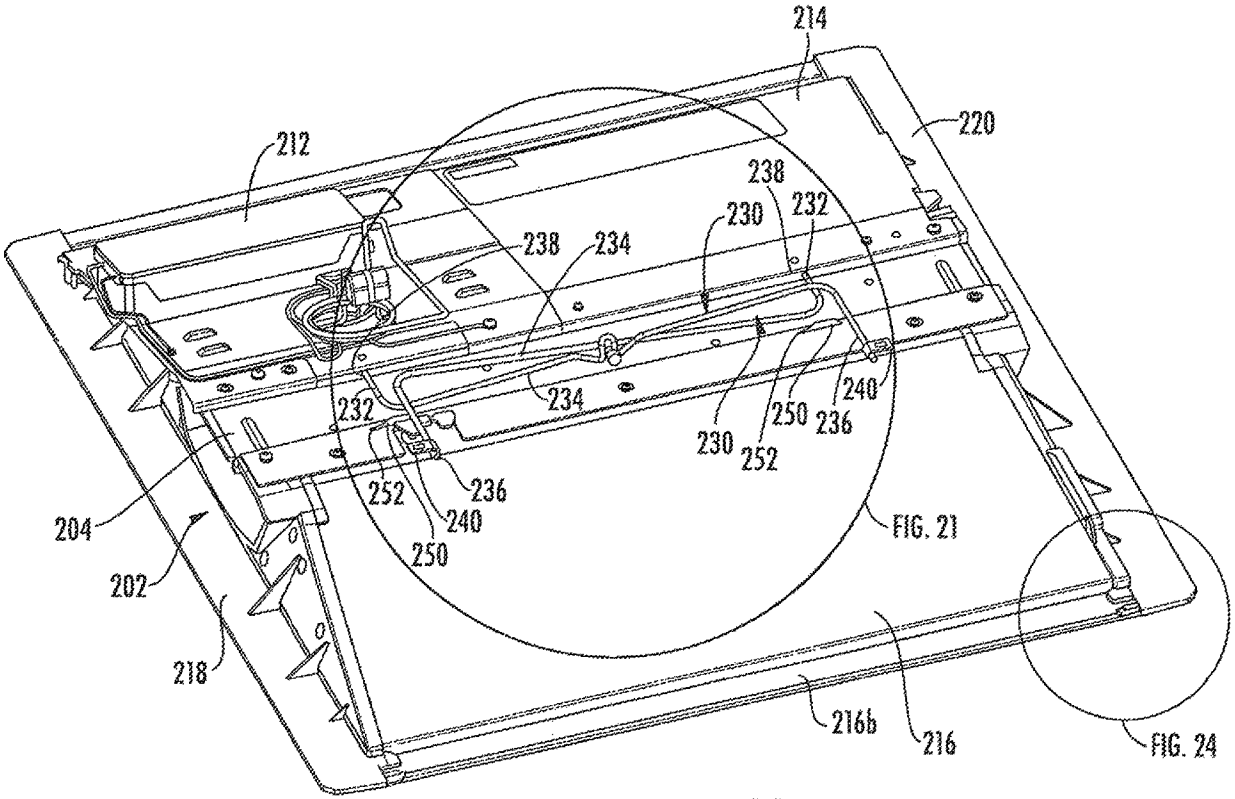
FIGS. 20 and 21 are top perspective views of a light fixture and mechanical attachment mechanism for mechanically securing the light fixture to a troffer.

The electronic circuitry for powering the LEDs 206 such as the driver and power supply and other control circuitry may be contained as part of the light emitting assembly 202 or some or all of the lamp electronics 212 may be supported separately from the light emitting assembly such as on stationary back reflector 214 as shown in FIG. 20.

Further, any of the embodiments disclosed herein may include one or more communication components forming a part of the light control circuitry, such as an RF antenna that senses RF energy. The communication components may be included, for example, to allow the luminaire to communicate with other luminaires and/or with an external wireless controller, such as disclosed in U.S. patent application Ser. No. 13/782,040, filed Mar. 1, 2013, entitled "Lighting Fixture for Distributed Control" or U.S. provisional application No. 61/932,058, filed Jan. 27, 2014, entitled "Enhanced Network Lighting" both owned by the assignee of the present application and the disclosures of which are incorporated by reference herein. More generally, the control circuitry includes at least one of a network component, an RF component, a control component, and a sensor. The sensor, such as a knob-shaped sensor, may provide an indication of ambient lighting levels thereto and/or occupancy within the room or illuminated area. Such sensor may be integrated into the light control circuitry. In various embodiments described herein various smart technologies may be incorporated in the lamps as described in the following applications "Solid State Lighting Switches and Fixtures Providing Selectively Linked Dimming and Color Control and Methods of Operating," application Ser. No. 13/295,609, filed Nov. 14, 2011, which is incorporated by reference herein in its entirety; "Master/Slave Arrangement for Lighting Fixture Modules," application Ser. No. 13/782,096, filed Mar. 1, 2013, which is incorporated by reference herein in its entirety; "Lighting Fixture for Automated Grouping," application Ser. No. 13/782,022, filed Mar. 1, 2013, which is incorporated by reference herein in its entirety; "Multi-Agent Intelligent Lighting System," application Ser. No. 13/782,040, filed Mar. 1, 2013, which is incorporated by reference herein in its entirety; "Routing Table Improvements for Wireless Lighting Networks," application Ser. No. 13/782,053, filed Mar. 1, 2013, which is incorporated by reference herein in its entirety; "Commissioning Device for Multi-Node Sensor and Control Networks," application Ser. No. 13/782,068, filed Mar. 1, 2013, which is incorporated by reference herein in its entirety; "Wireless Network Initialization for Lighting Systems," application Ser. No. 13/782,078, filed Mar. 1, 2013, which is incorporated by reference herein in its entirety; "Commissioning for a Lighting Network," application Ser. No. 13/782,131, filed Mar. 1, 2013, which is incorporated by reference herein in its entirety; "Ambient Light Monitoring in a Lighting Fixture," application Ser. No. 13/838,398, filed Mar. 15, 2013, which is incorporated by reference herein in its entirety; "System, Devices and Methods for Controlling One or More Lights," application Ser. No. 14/052,336, filed Oct. 10, 2013, which is incorporated by reference herein in its entirety; and "Enhanced Network Lighting," application Ser. No. 61/932,058, filed Jan. 27, 2014, which is incorporated by reference herein in its entirety. Additionally, any of the light fixtures described herein can include the smart lighting control technologies disclosed in U.S. Provisional Application Ser. No. 62/292,528, titled "Distributed Lighting Network", filed on Feb. 8, 2016 and assigned to the same assignee as the present application, the entirety of this application being incorporated by reference herein.

The light fixture 200 further comprises a reflector assembly 215 for directing light in a desired emission pattern. The reflector assembly 215 may comprise a back reflector that may be made of a first back reflector 214 and a second back reflector 216 and end reflectors 218 and 220. While a specific configuration of a reflector assembly 215 is shown the reflector may have any suitable configuration based on the desired light emission pattern and the configuration of the troffer.

The first back reflector 214 and a second back reflector 216 are connected to the support structure 204. The back reflectors 214, 216 may be removably and adjustably connected to and/or supported by the support structure 204. In some embodiments, one back reflector 216 may be removably or movably connected to the support structure 204 while the other back reflector 214 is permanently connected to the support structure 204. In other embodiments both back reflectors 214, 216 may be removably or movably connected to the support structure 204. A first end reflector 218 may be fixed or movably mounted to a first end of the light emitting assembly 202 and a second end reflector 220 may be fixed or movably mounted to a second end of the light emitting assembly 202. In the illustrated embodiment, end reflector 218 is fixed to the light emitting assembly 202 while end reflector 220 is slidably mounted to the light emitting assembly 202.

Figure 14:
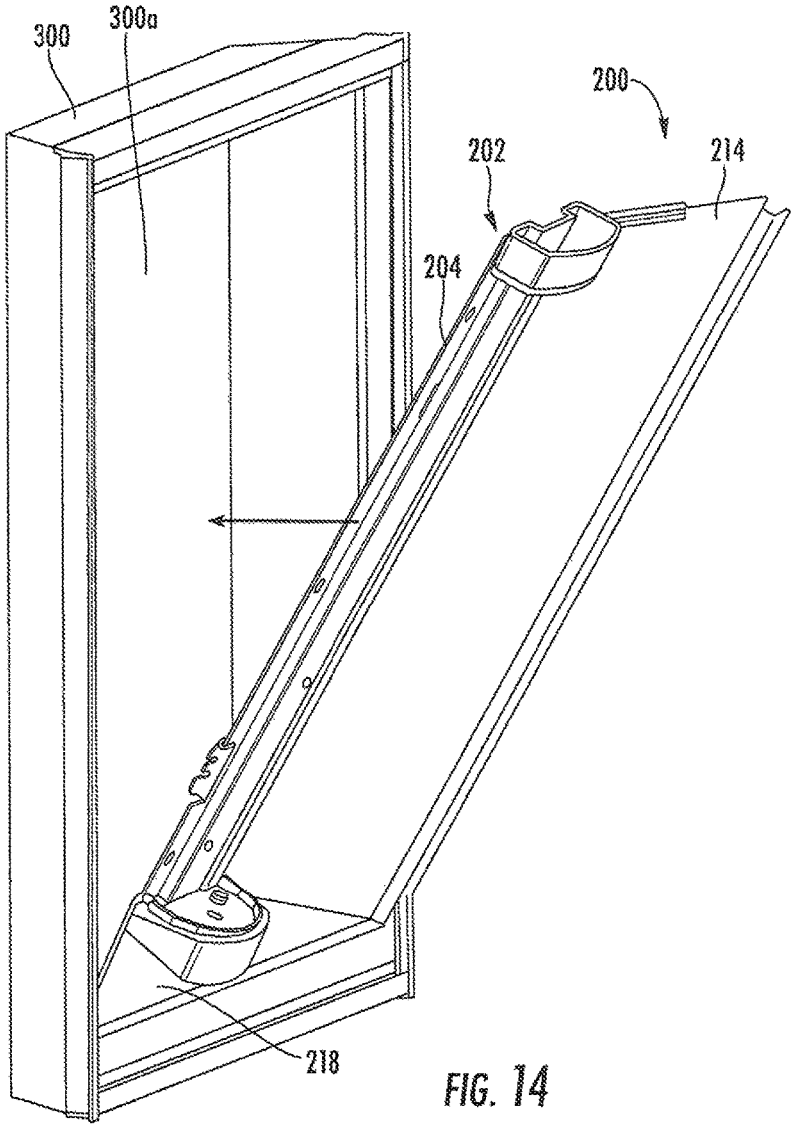
FIG. 14 is a perspective view showing the installation of an embodiment of the light fixture of the invention in a troffer.
Figure 15:
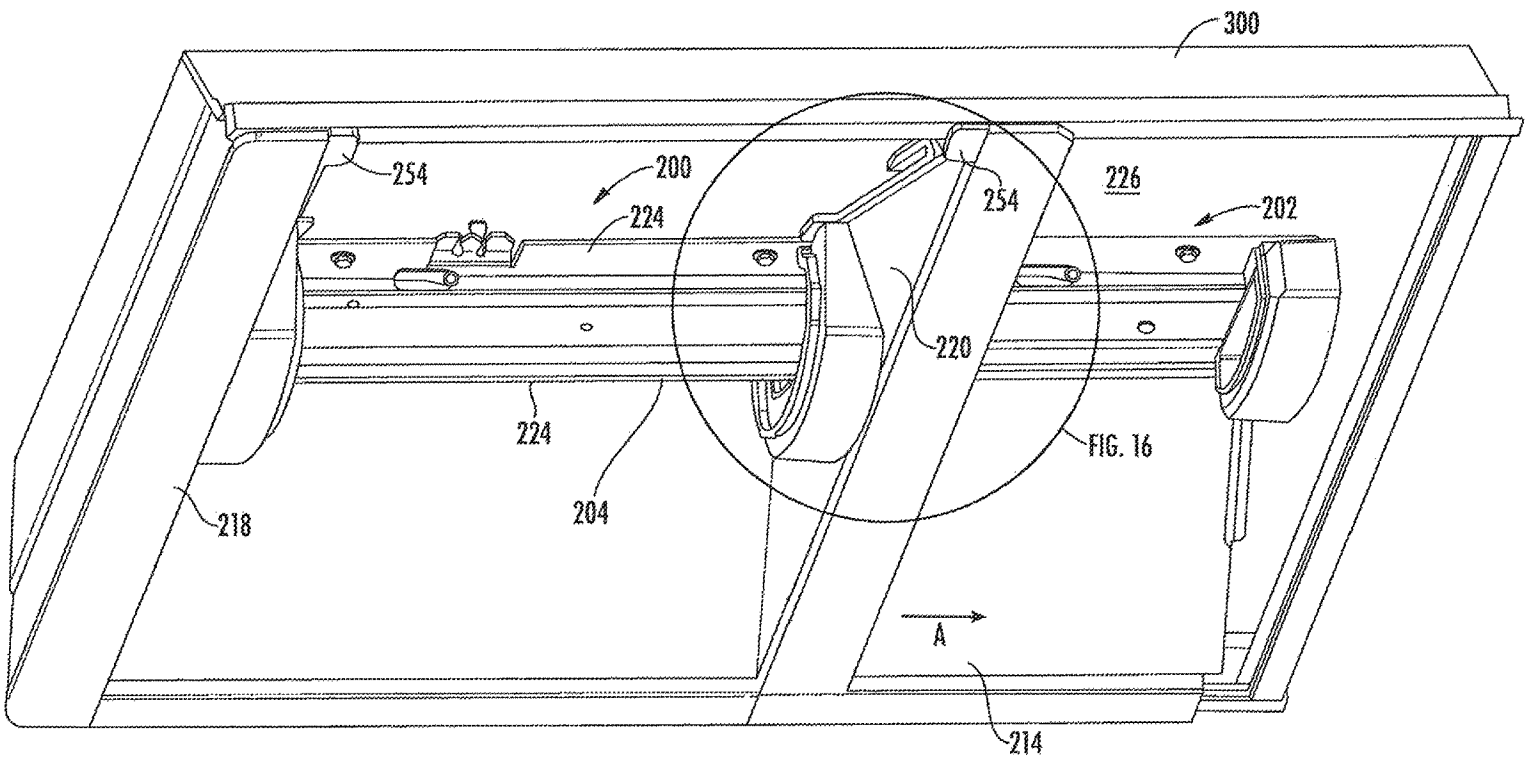
FIG. 15 is a perspective view showing the further installation of the embodiment of the light fixture of FIG. 14.

The light fixture 200 may be mounted in a troffer 300 as previously described. Referring to FIG. 13, if necessary the legacy fluorescent bulbs 302, ballast cover 304, ballast 306, lamp holders (tombstone connectors) 308, and lens/louvre cover 310 are removed from troffer 300 to allow the light fixture 200 to be mounted therein. The troffer may be mounted in a T-grid 320 in a ceiling. Referring to FIG. 14 to install the light fixture 200 in troffer 300 the assembly comprising the light emitting assembly 202, fixed end reflector 218 and fixed back reflector 214 is positioned in the troffer 300. Referring to FIG. 15 the movable side reflector 220 is mounted on the support structure 204 and is slid to the end of the troffer in the direction of arrow A. As shown in FIG. 16 the movable side reflector 220 has flanges **220*a* that fit onto and slide over rails 224** formed on support structure 204. In one embodiment the movable end reflector 220 is snap fit onto the rails 224 formed in the support structure such that the movable side reflector may be slid relative to the support structure to the end of the troffer. In some embodiments the movable end reflector 220 may be permanently but slidably secured to the support structure 204 such that the movable end reflector 220 is installed with the assembly in the installation step shown in FIG. 14. With the side reflectors in position the light fixture is supported in the troffer by the ceiling T-grid system 320. The power supply wires 322 from the building infrastructure are connected to the lamp electronics 212 through the opening 226 created by the removal of back reflector 216.

After the light fixture is mechanically secured to the troffer the lens 210 may be attached to the support structure to cover the LEDs. The lens may flex and be snap fit over flanges formed on the support structure as shown in FIG. 18.

After the electrical wiring connection to the light fixture 200 is complete, the light fixture 200 is mechanically secured directly to the troffer 300 by a mechanical attachment mechanism. Referring to FIGS. 20-23, in one embodiment the mechanical attachment mechanism comprises pivoting brackets 230 that are pivotably mounted to the support structure 204 of the light fixture. Two brackets 230 are provided that comprise a wireform bent to have a first leg or pivot axis 232 connected to an elongated second leg or body 234 that terminates in a third leg or connector portion 236. The first leg 232 defines a pivot axis of the bracket 230 and is captured by an aperture 238 that is formed in the light fixture such that the bracket 230 may rotate or pivot relative to the light fixture about axis A-A. The pivot axis may be formed by other than an aperture in the support structure 204. For example, the first leg 232 may be captured by brackets attached to the support structure.

The connector portions 236 of the brackets 230 comprise an attachment structure 240 that is configured to be secured to the troffer 300. The attachment structure 240 in one embodiment comprises a plate defining an aperture or eyelet 242 through which a machine screw 243 may be inserted that is fastened to the troffer 300. The plate may be pivotably mounted to the body bracket such that it may rotate flush against the surface 300*a* of troffer 300. While the attachment structure is shown as an aperture or eyelet 242 for receiving a screw 243 the attachment structure may comprise a variety of structures provided that the attachment structure can be securely mechanically attached to the troffer. For example, the attachment structure 240 may comprise a sleeve that permanently and rotatably retains a screw where the screw may be screwed into troffer 300. Alternatively the attachment structure 240 may comprise a flat plate that is attached to the troffer 300 by welding, brazing, adhesive, rivets or the like. Moreover, a combination of attachment structures may be used. In other embodiments the attachment structure 240 may comprise a first mating attachment device that is secured to the troffer 300 that is engaged by a second mating attachment device on the brackets 230.

The second leg or body 234 extends for a length sufficient such that the attachment structure 240 of the bracket 230 may be positioned adjacent the interior surface 300*a* of the troffer 300. Because troffers are made in different sizes and depths the distance from the top of the light fixture 200 to the interior surface 300*a* of troffer 300 may vary depending on the type and installation of the troffer 300. Making the brackets 230 of suitable length and pivotable to the light fixture 200 allows the distance d between the top of the light fixture 200 and the attachment structure 240 to be variable and adjusted during installation of the light fixture to accommodate the variations in troffer sizes as shown, for example, in FIGS. 22 and 23.

Moreover, while the brackets 230 have been shown and described as wireforms bent to create the pivot axis 232, body 234 and connector portion 236, the brackets 230 may be formed of other structures than a wireform. For example the elongated body 234 may be formed as an L-bracket, I bar, T bar or the like made of sheet metal, plastic or other suitable material and the pivot axis and attachment structure 240 may be separately formed and secured to the body.

Figure 21:
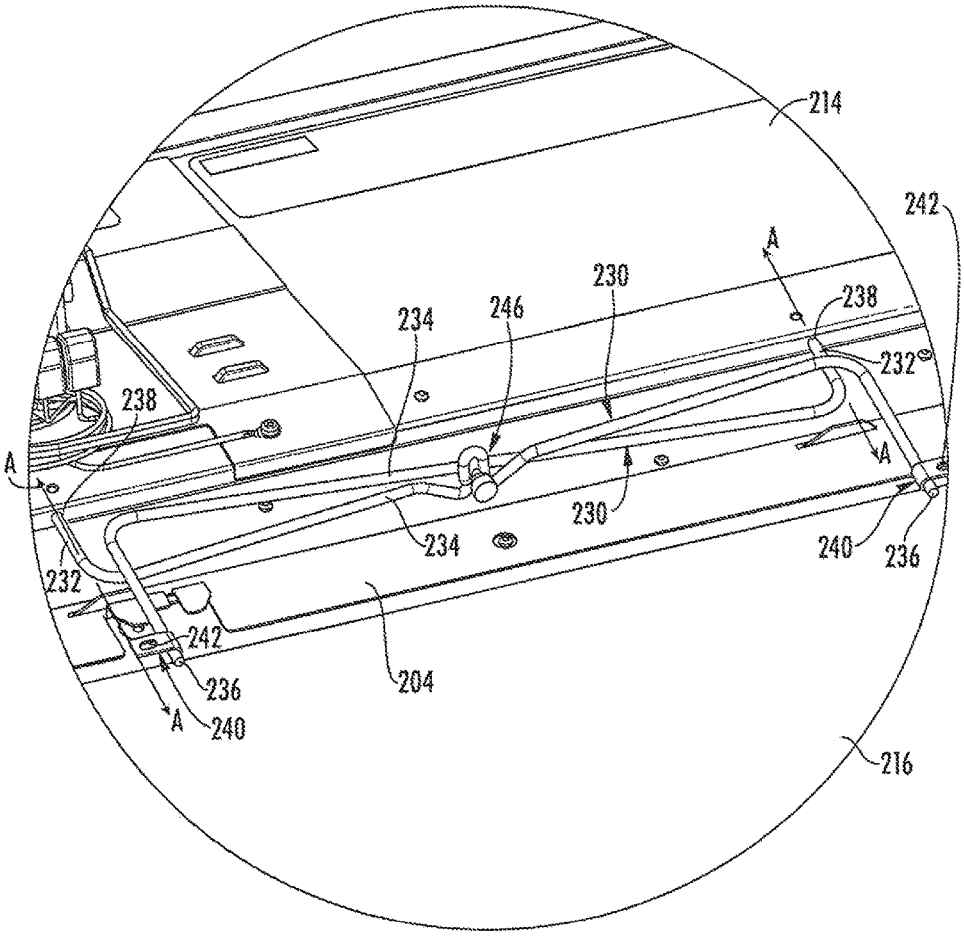
Figure 22:
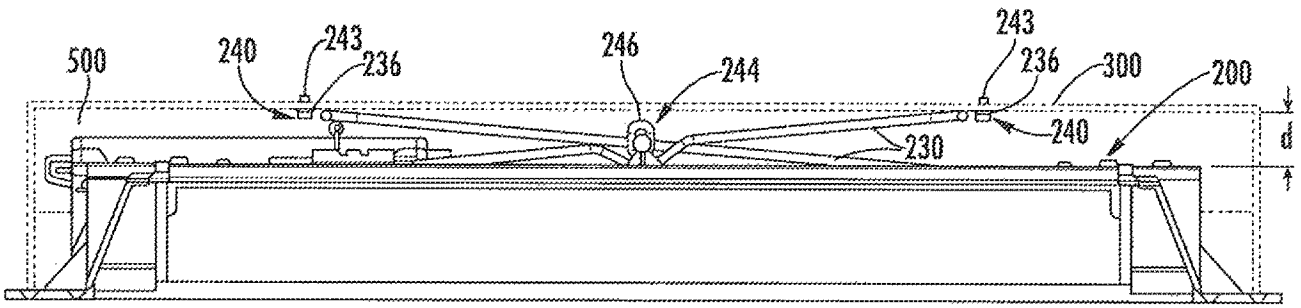
FIGS. 22 and 23 are side views showing the mechanical attachment mechanism of FIGS. 20 and 21 as mounted in different size troffers.
Figure 23:
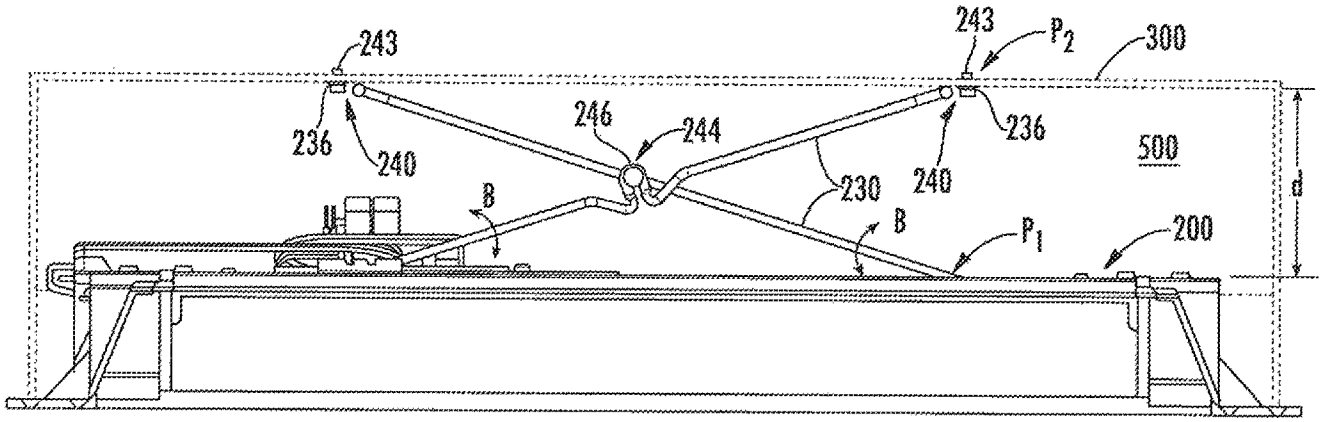
Figure 26A:
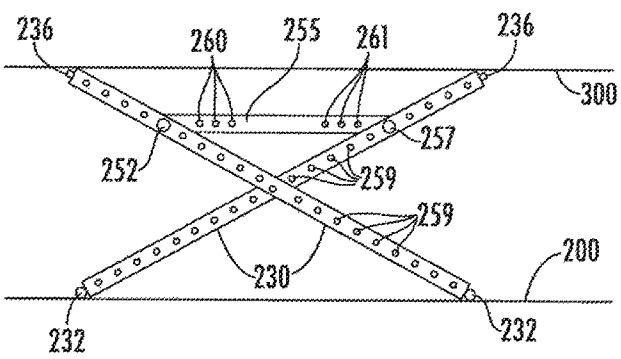
FIGS. 25-26*b* are schematic views of alternate embodiments of the mechanical attachment mechanism of FIGS. 20 and 21.
Figure 26B:
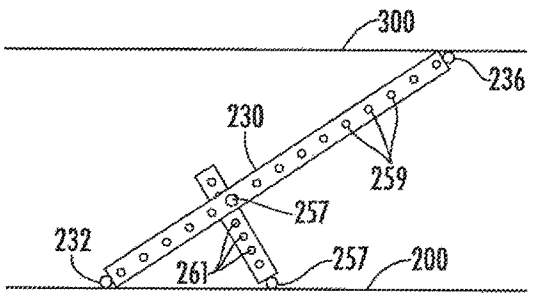
Figure 25:
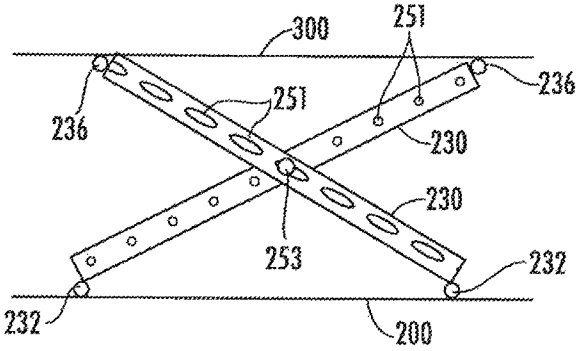

Referring to FIGS. 21 through 23 the two brackets 230 are mounted on the light fixture 200 such that the brackets cross one another when pivoted about their respective pivot axes A-A. The brackets 230 are rotated such that the attachment structure 240 is disposed adjacent the troffer 300 as shown by arrows B in FIG. 23. When the attachment structure 240 is positioned adjacent the troffer it may be secured thereto by screws 243 rivets or other connection device. After the brackets 230 are secured to the troffer 300, the brackets may be secured to one another at the cross point 244 using a coupling 246 such that they are locked in position relative to one another. The coupling 246 may comprise a set screw that may be mounted on one bracket such that is can traverse the length of the bracket as the brackets are rotated. Once the brackets 230 are connected to the troffer the set screw may be tightened to engage the other bracket to fix the brackets relative to one another. In other embodiments the coupling may comprise a series of apertures 251 formed on the brackets 230 that may be aligned at the cross point to receive a screw, pin or other connector 253 as shown in FIG. 25. In still other embodiments the coupling may comprise flat faces that may be welded or brazed together. In other embodiments the coupling 246 may comprise a separate bar or rod 255 secured between the two brackets 230 at points other than the cross point as shown in FIG. 26*a*. Moreover, only one pivoting bracket 230 may be used and a separate bar or rod 255 may be secured between the one bracket 230 and the light fixture to prevent rotation of the bracket 230 in the installed position as shown in dashed lines in FIG. 26*b*. The bracket 255 may be pivoted to the light fixture at pivot 257. A series of apertures 259 formed on the brackets 230 may be aligned with apertures 261 on the bar or rod 255 to receive a screw, pin or other connector 257. While a permanent coupling such as a weld may be used, use of a removable coupling such as a set screw or pin arrangement may make removal of the light fixture easier.

As shown for example in FIGS. 22 and 23 the light fixture 200 forms the bottom half of an electrical enclosure and the existing troffer 300 forms the top half to create an isolated space therebetween. The two are secured together via the mechanical attachment mechanism to provide a direct, positive mechanical connection between the light fixture and troffer to create an enclosure that may contain wiring, splices, electrical components, drivers, controls, or the like and to protect from risk of fire or shock. The mechanical attachment mechanism is adjustable to fit troffers of different styles and heights to the light fixture. The mechanical attachment mechanism positively secures the light fixture to the troffer without gaps to create an electrical enclose that prevents risk of fire or shock. The mechanical attachment mechanism is configured to be secured to the troffer and mechanically secures the light fixture directly to the troffer without the use of building support structure or Tgrid in order to function as an electrical enclosure. As a result the troffer is directly mechanically secured to the light fixture independently of any surrounding support system.

Figure 24:
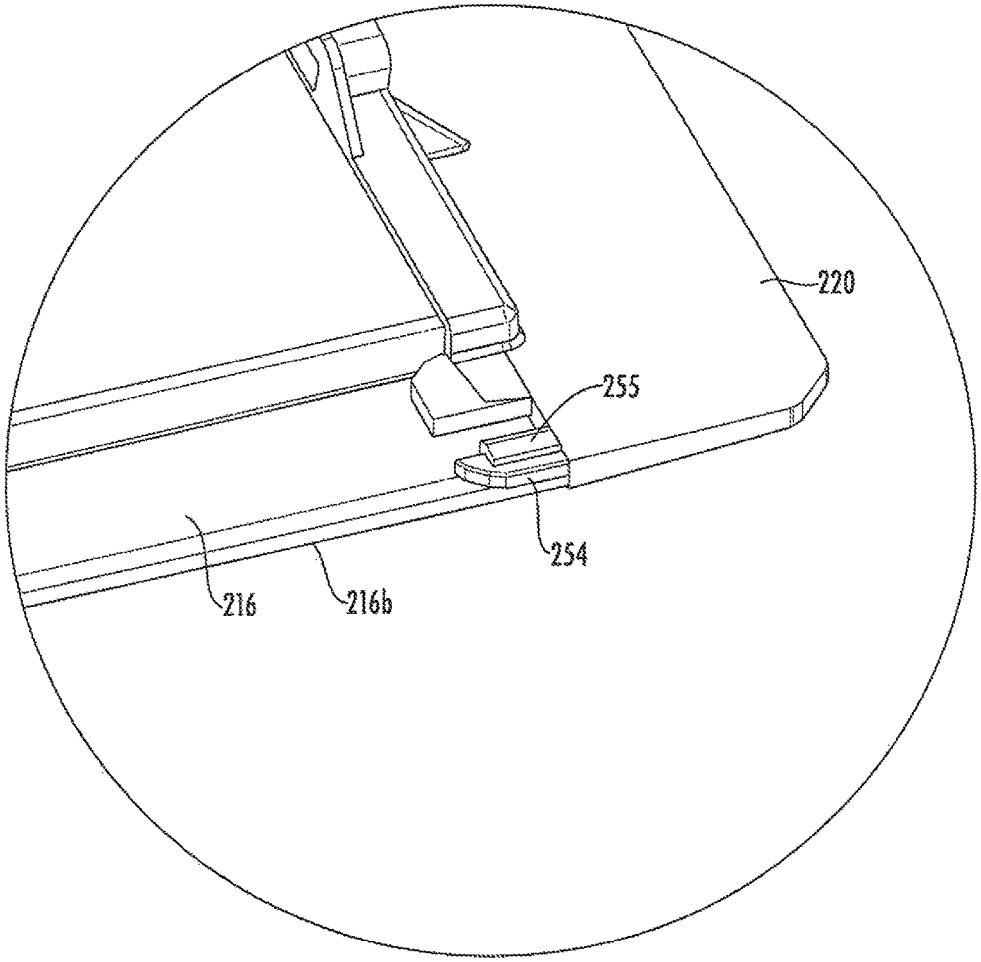
FIG. 24 is a partial perspective view showing an embodiment of the attachment between the back reflector and the troffer.

After the brackets 230 mechanically secure the light fixture directly to the troffer, the second back reflector 216 may be installed to cover the opening 226 and hide the mounting brackets 230 and the interior of the troffer 300. Referring to FIGS. 17 and 20, the second, removable back reflector 216 may be provided with latches or tabs 250 on its inner edge 216*a* that engage slots 252 formed on the support structure. With the latches 250 engaging the slots 252 the outer edge 216*b* of the second back reflector 216 may be pivoted into position inside of the troffer 300. Slots 255 formed at the corners of the outer edge 216*b* of the back reflector may be engaged by tabs 254 or other interlocking mechanisms formed in the side reflectors 218, 220 to retain the back reflector 216 in position as shown in FIGS. 20 and 24. The interlocking mechanisms may be reversed where slots on the back reflector 216 are engaged by tabs on the side reflectors 218, 220. It will be appreciated that the interlocking mechanism between the outer edge 216*a* of the back reflector 216 and the side reflectors 218, 220 may take many forms. For example, separate fasteners may be used that engage both the side reflector and the back reflector.

Figure 27:
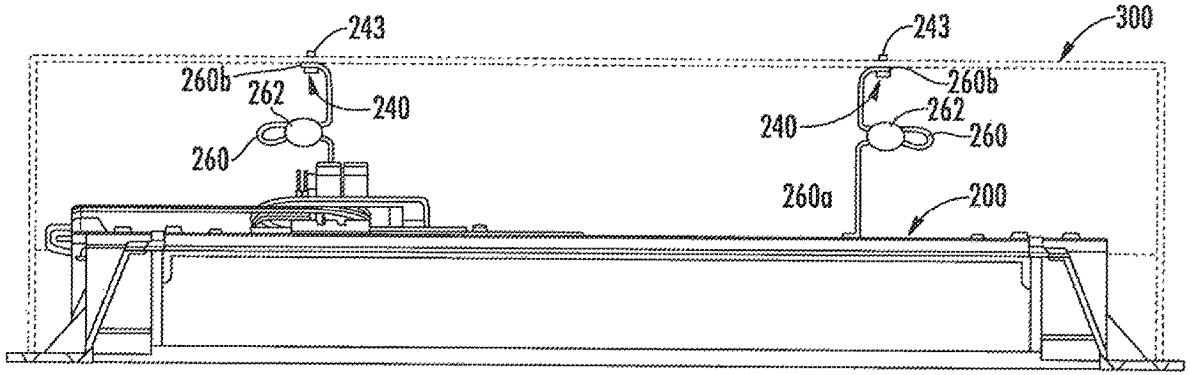
FIGS. 27 and 28 are side views showing another embodiment of a mechanical attachment mechanism for securing the light fixture to a troffer as mounted in different sixe troffers.
Figure 28:
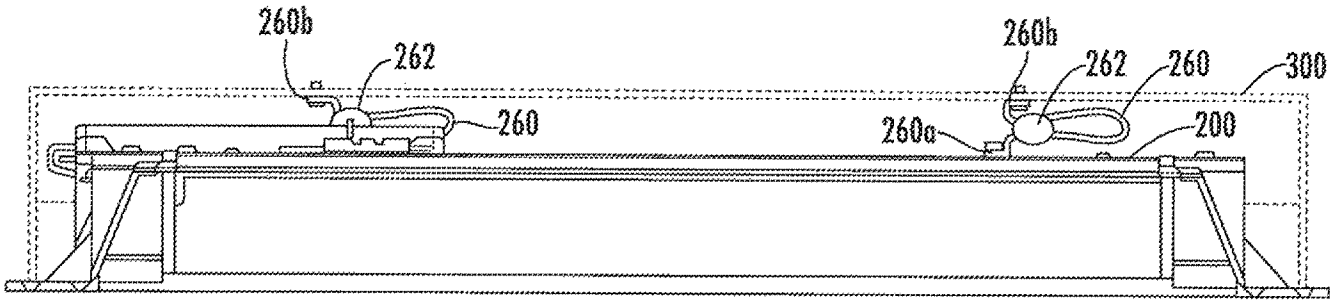

Referring to FIGS. 27 and 28 in another embodiment the mechanical attachment mechanism is provided by a cable 260 that has one end 260*a* secured to the light fixture 200 such as by a bracket and screw. A second end 260*b* of the cable 260 includes an attachment structure 240 as previously described that may be attached to the troffer by a screw 243 or other attachment device during installation of the light fixture. Because the distance between the light fixture and troffer may vary in different installations the length of the cable is sufficient to span the largest distance between the light fixture and troffer. To adjust the effective length of the cable a cable grip 262 may be provided to take up any slack in the cable. The extra cable length may be pulled through the grip 262 and the grip tightened onto the cable to maintain the appropriate effective length of cable to mechanically secure the light fixture 200 directly to the housing 300. The term "effective length" means that the linear length of the cable between its two connection points after adjustment is substantially equal to distance d.

Figure 29:
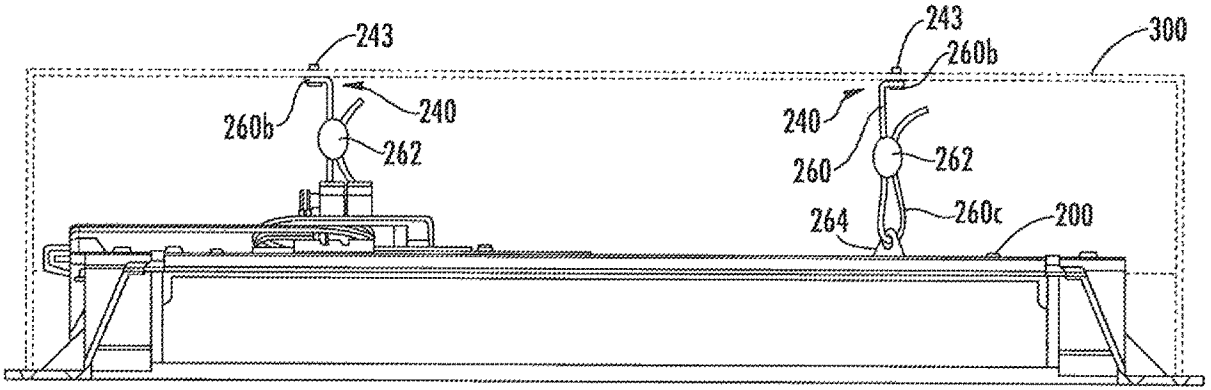
FIGS. 29 and 30 are side views showing another embodiment of a mechanical attachment mechanism for securing the light fixture to a troffer as mounted in different sixe troffers.
Figure 30:
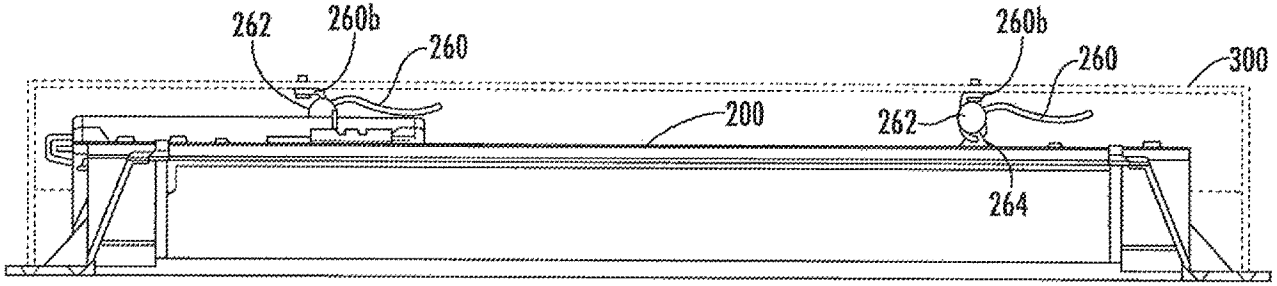

Referring to FIGS. 29 and 30 in another embodiment the cable 260 may be formed in a loop 260*c* by an adjustable cable grip 262. The loop may be secured to the light fixture 200 by a suitable bracket 264 and the free end 260*b* of the cable 260 may be secured to the troffer 300 during installation of the light fixture using an attachment structure 240 as previously described. The effective length of the cable 260 may be adjusted and fixed using the cable grip 262 to equal the distance d between the troffer 300 and the light fixture 200. In another embodiment the loop may be connected to the attachment structure 240 and the free end of the cable may be connected to the light fixture.

Figure 31:
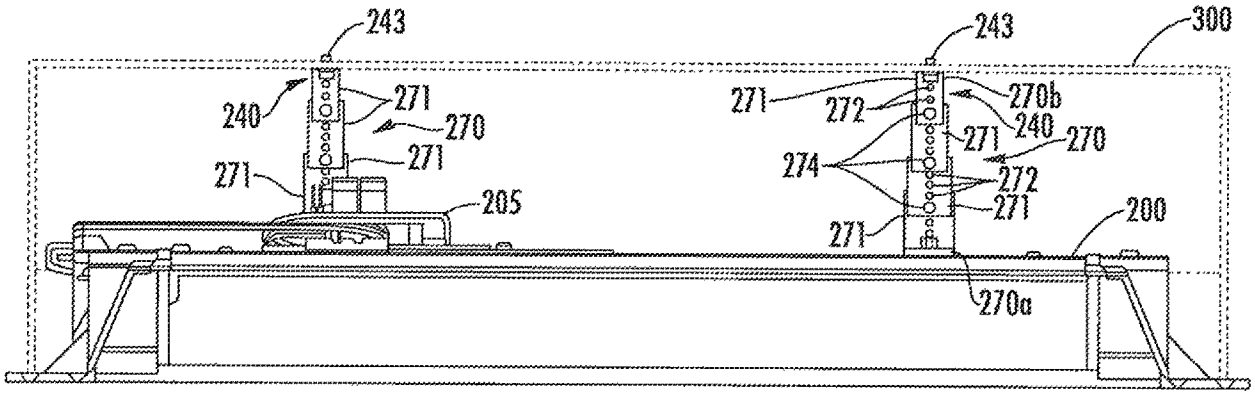
FIGS. 31 and 32 are side views showing another embodiment of a mechanical attachment mechanism for securing the light fixture to a troffer as mounted in different sixe troffers.
Figure 32:
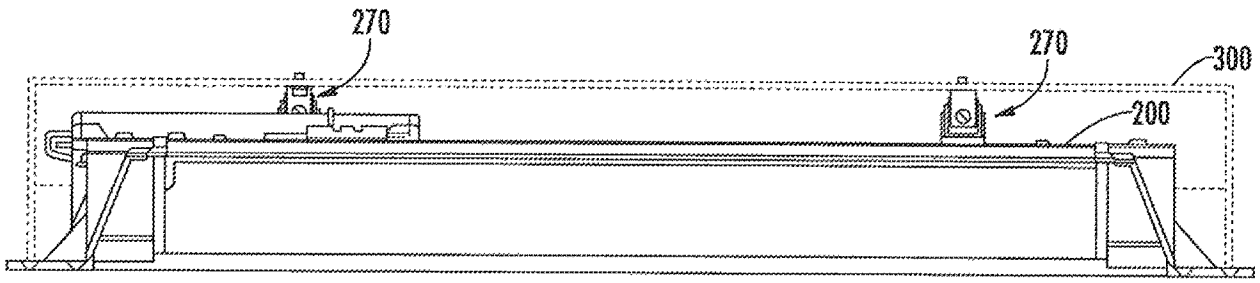

Referring to FIGS. 31 and 32 in another embodiment the mechanical connection is provided by an adjustable sheet metal bracket 270 that has a first end 270*a* mounted to the support structure 204 of light fixture 200 and a second end 270*b* that extends to the troffer 300. The length of the bracket 270 may be adjusted during installation and the free end 270*b* of the bracket may be secured to the troffer using an attachment structure 240 as previously described. The adjustability of the brackets may be provided by providing each bracket with plural sections 271 that telescope relative to one another. The bracket sections 271 may be provided with a plurality of spaced apertures 272. A fastener 274 may fix the bracket sections 271 relative to one another by engaging the apertures formed on the bracket sections. The bracket portions may be fixed relative to one another by any suitable fastener such as a screw, nut and bolt, pin, rivet or the like. The bracket section may also be fixed relative to one another using other mechanism such as locking colors, ratchets or the like.

Figure 33:
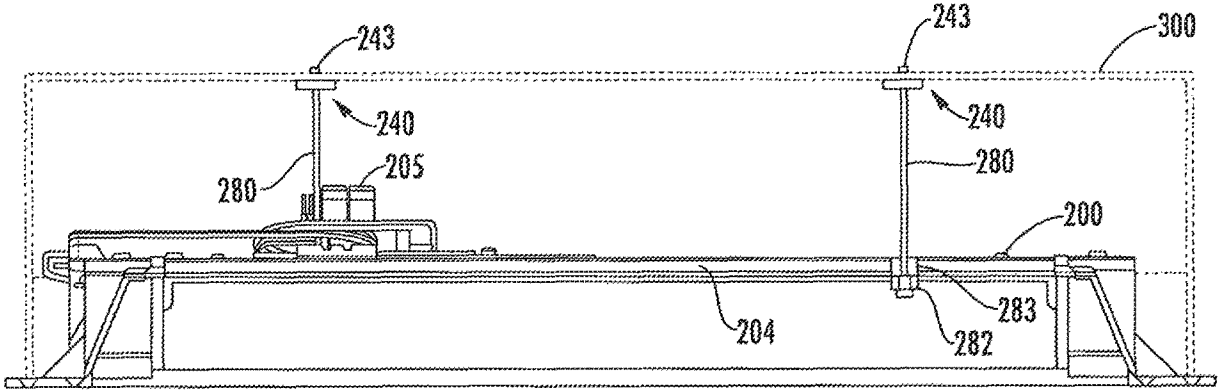
FIGS. 33 and 34 are side views showing another embodiment of a mechanical attachment mechanism for securing the light fixture to a troffer as mounted in different sixe troffers.
Figure 34:
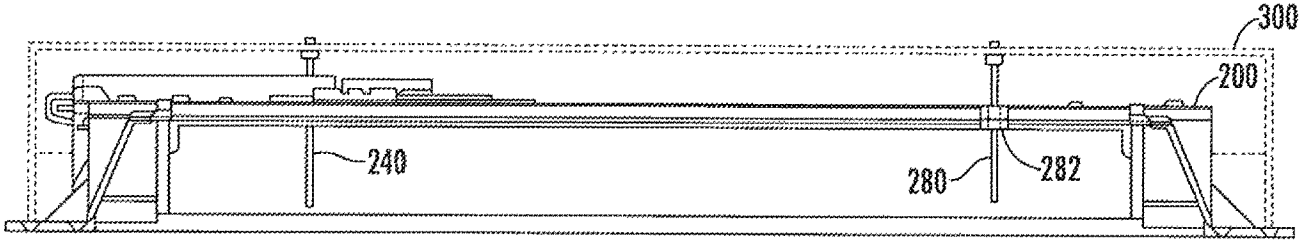

Referring to FIGS. 33 and 34 in another embodiment the mechanical connection is provided by a threaded post 280 that may be fixed to the troffer using an attachment structure 240 as previously described. The threaded post 280 extends down from the troffer 300. The post 280 may be inserted through an aperture 283 formed in the support structure 204 of the light fixture 200. A threaded nut 282 engages the post 280 to fix the light fixture 200 to the troffer 300. The threaded nut may be threaded onto the post to adjust the effective length of the post. The post may be positioned such that when the lens 210 is secured in position the exposed end of the post is covered by the lens.

In the direct mechanical connection between the troffer and light fixture, the mechanical attachment mechanism is adjustable such that the distance d between the connection point $P_1$ where the mechanical attachment mechanism is connected to the light fixture 200 and the connection point $P_2$ where the mechanical attachment mechanism is connected to the troffer 300 may be adjusted during the installation process to accommodate the different spacing that may be found between the light fixture and the various styles, types and sizes of troffers. While the illustrated embodiments show two mechanical attachment mechanisms connecting the fixture to the enclosure a greater or fewer number of mechanical attachment mechanisms may be used to secure the fixture to the troffer. Moreover, two different types of mechanical attachment mechanisms may be used between the same light source and troffer. The mechanical attachment mechanisms may be attached to any suitable portion of the light fixture and troffer that adequately support the connection. Where more than one mechanical attachment mechanism is used to attach a light fixture to a troffer the mechanical attachment mechanisms may be adjusted to different lengths to span different distances d based on the topography of the light fixture and the troffer. For example referring to FIGS. 31 and 33 the right hand mechanical attachment mechanism may be secured to the support member 202 and be longer than the left hand mechanical attachment member that is attached to structure 205.

The light fixture 200 forms the bottom half of an electrical enclosure and the existing troffer 300 forms the top half. The two are secured together via the mechanical attachment mechanism to provide a direct, positive mechanical connection between the light fixture and troffer to create an enclosure that may contain wiring, splices, electrical components, drivers, controls, or the like and to protect from risk of fire or shock. The mechanical attachment mechanism is adjustable to fit troffers of different styles and heights to the light fixture. The mechanical attachment mechanism positively secures the light fixture to the troffer without gaps to create an electrical enclose that prevents risk of fire or shock. The mechanical attachment mechanism positively secures the light fixture to the troffer in a plane perpendicular to the plane of the LEDs and supporting Tgrid, typically the plane will be vertical. The position of the light fixture is also fixed in a second plane perpendicular to the first plane, where the second plane is parallel to the Tgrid and is typically horizontal, by the positioning of the light fixture at least partially inside of the troffer, where engagement of the edges of the light fixture with the troffer fix the light fixture against lateral movement. As a result the light fixture is fixed relative to the troffer in two perpendicular planes.

Although specific embodiments have been shown and described herein, those of ordinary skill in the art appreciate that any arrangement, which is calculated to achieve the same purpose, may be substituted for the specific embodiments shown and that the invention has other applications in other environments. This application is intended to cover any adaptations or variations of the present invention. The following claims are in no way intended to limit the scope of the invention to the specific embodiments described herein.

We claim:

1. A light fixture configured to be mounted in a troffer, comprising:

a light emitting assembly comprising at least one LED;

a reflector assembly; and a mechanical attachment mechanism configured to be connected directly between the light fixture and a troffer, the mechanical attachment mechanism comprising an attachment structure configured to be secured to the troffer, the distance between the attachment structure and the light fixture being adjustable such that a distance between the light fixture and the troffer may vary, wherein the mechanical attachment mechanism comprises at least one bracket pivotably connected to the light fixture.

2. The fixture of claim 1, wherein the reflector assembly comprises a back reflector, the back reflector comprising at least two reflectors, wherein a first one of the two reflectors is movable relative to the light emitting assembly.

3. The fixture of claim 2, wherein the reflector assembly comprises two end reflectors where at least one of the two side reflectors is moveable relative to the light emitting assembly.

4. The fixture of claim 1, wherein the distance between the attachment structure and the light fixture is adjustable by pivoting of the bracket.

5. The fixture of claim 1, wherein the mechanical attachment mechanism comprises two brackets pivotably connected to the light fixture.

6. The fixture of claim 5, wherein the two brackets are secured to one another.

7. The fixture of claim 4, wherein the at least one bracket is secured against pivoting movement.

8. A light fixture configured to be mounted in a troffer having a size, comprising:

a light emitting assembly comprising at least one LED;

a reflector assembly; and a mechanical attachment mechanism secured to the light fixture and a troffer, the mechanical attachment mechanism comprising an attachment structure spaced from the light fixture, the position of the attachment structure being adjustable relative to the light fixture such that the distance between the attachment structure and the light fixture is changeable;

wherein the reflector assembly comprises a back reflector, the back reflector comprising at least two reflectors, wherein at least one of the two reflectors is movable relative to the light emitting assembly to adjust a size the reflector assembly to fit the size of the troffer.

9. The fixture of claim 8, wherein the mechanical attachment mechanism comprises at least one bracket pivotably connected to the light fixture where the distance between the attachment structure and the light fixture is changed by pivoting of the bracket.

10. The fixture of claim 9, wherein the mechanical attachment mechanism comprises two brackets pivotably connected to the light fixture.

11. The fixture of claim 10, wherein the two brackets are secured to one another.

12. The fixture of claim 8, wherein the mechanical attachment mechanism mechanically secures the light fixture directly to the troffer to create an enclosure independently of any surrounding support system.

13. The fixture of claim 8, wherein the mechanical attachment mechanism comprises a cable wherein the effective length of the cable is adjustable to change the distance between the attachment structure and the light fixture.

14. The fixture of claim 8, wherein the mechanical attachment mechanism comprises a telescoping bracket comprising a plurality if sections movable relative to one another wherein the effective length of the telescoping bracket is adjustable to change the distance between the attachment structure and the light fixture.

15. The fixture of claim 8, wherein the mechanical attachment mechanism comprises a threaded member wherein the effective length of the threaded member is adjustable by a threaded nut that engages the threaded member to change the distance between the attachment structure and the light fixture.

16. The fixture of claim 9, wherein two mechanical attachment mechanisms are secured to the light fixture and a troffer where the distance between the attachment structure and the light fixture is different for a first one of the two mechanical attachment mechanisms than distance between the attachment structure and the light fixture for a second one of the two mechanical attachment mechanisms.

17. A light fixture and a troffer having a size, comprising:

the light fixture comprising a light emitting assembly comprising at least one LED and a reflector assembly;

the light fixture being positioned at least partially inside of the troffer to fix the position of the light fixture relative to the troffer in a first plane; and a mechanical attachment mechanism secured to the light fixture and a troffer, the mechanical attachment mechanism fixing the light fixture to the troffer in a second plane perpendicular to the first plane, wherein the reflector assembly comprises two end reflectors where at least one of the two end reflectors is moveable relative to the light emitting assembly to adjust a size the reflector assembly to fit the size of the troffer.

18. A light fixture configured to be mounted in a troffer, comprising:

a light emitting assembly comprising at least one LED;

a reflector assembly; and a mechanical attachment mechanism configured to be connected directly between the light fixture and a troffer, the mechanical attachment mechanism comprising an attachment structure configured to be secured to the troffer, the distance between the attachment structure and the light fixture being adjustable such that a distance between the light fixture and the troffer may vary, wherein the mechanical attachment mechanism comprises a cable having an attachment structure wherein the effective length of the cable is adjustable to change the distance between the attachment structure and the light fixture.

19. A light fixture configured to be mounted in a troffer, comprising:

a light emitting assembly comprising at least one LED;

a reflector assembly; and a mechanical attachment mechanism configured to be connected directly between the light fixture and a troffer, the mechanical attachment mechanism comprising an attachment structure configured to be secured to the troffer, the distance between the attachment structure and the light fixture being adjustable such that a distance between the light fixture and the troffer may vary, wherein the mechanical attachment mechanism comprises a telescoping bracket having an attachment structure wherein the effective length of the telescoping bracket is adjustable to change the distance between the attachment structure and the light fixture.

20. A light fixture configured to be mounted in a troffer, comprising:

a light emitting assembly comprising at least one LED;

a reflector assembly; and a mechanical attachment mechanism configured to be connected directly between the light fixture and a troffer, the mechanical attachment mechanism comprising an attachment structure configured to be secured to the troffer, the distance between the attachment structure and the light fixture being adjustable such that a distance between the light fixture and the troffer may vary, wherein the mechanical attachment mechanism comprises a threaded member having an attachment structure wherein the effective length of the threaded member is adjustable by a threaded nut that engages the threaded member to change the distance between the attachment structure and the light fixture.

* * * * *